US007090586B1

(12) United States Patent
Everett et al.

(10) Patent No.: US 7,090,586 B1
(45) Date of Patent: Aug. 15, 2006

(54) ACTIVITY SURFACES

(75) Inventors: Robert Everett, West Yorkshire (GB); Stephen Morley, London (GB); Andrew Whitworth, Nottingham (GB); Paul Morton, Sheffield (GB)

(73) Assignee: Ascot Racecourse Limited, London (GB)

( * ) Notice: Subject to any disclaimer, the term of this patent is extended or adjusted under 35 U.S.C. 154(b) by 351 days.

(21) Appl. No.: 10/089,777

(22) PCT Filed: Sep. 29, 2000

(86) PCT No.: PCT/GB00/03739

§ 371 (c)(1),
(2), (4) Date: Jun. 18, 2002

(87) PCT Pub. No.: WO01/24894

PCT Pub. Date: Apr. 12, 2001

(30) Foreign Application Priority Data

Oct. 1, 1999 (GB) ..... 9923325
Oct. 5, 1999 (GB) ..... 9923520

(51) Int. Cl.
*E01C 13/00* (2006.01)

(52) U.S. Cl. ..... 472/92; 472/91; 404/99

(58) Field of Classification Search ..... 472/85–92; 52/6–10; 404/99

See application file for complete search history.

(56) References Cited

U.S. PATENT DOCUMENTS 2,650,826 A 9/1953 Alessio
2,757,930 A 8/1956 White et al.
3,948,344 A 4/1976 Johnson et al.
3,975,869 A 8/1976 Bouton
4,058,930 A 11/1977 Miles
4,067,716 A 1/1978 Sterrett
4,111,585 A 9/1978 Mascaro
4,216,615 A 8/1980 Soderberg et al.
4,281,831 A 8/1981 Bird
4,352,256 A 10/1982 Kranz
4,631,869 A 12/1986 Miyatake et al.
4,688,357 A 8/1987 Deaton
4,738,407 A 4/1988 Arrant
4,837,971 A 6/1989 Visser
4,907,793 A 3/1990 Wund
4,926,586 A 5/1990 Nagamatsu
5,187,894 A * 2/1993 Ripley et al. ..... 47/86
5,365,704 A * 11/1994 Ray ..... 52/64
RE35,006 E 8/1995 Ripley, Sr. et al.
5,468,190 A * 11/1995 McCaffrey ..... 472/82
5,746,028 A * 5/1998 DiBenedetto ..... 52/6

FOREIGN PATENT DOCUMENTS

DE 25 43 176 A 4/1977

(Continued)

*Primary Examiner*—Kien Nguyen
(74) *Attorney, Agent, or Firm*—Dinsmore & Shohl, LLP

(57) ABSTRACT

An apparatus for an a method of closing a fixed gap in an activity surface such as a turfed race-track is described. The apparatus comprises a movable turf tray having an upper surface with the same characteristics as the activity surface and means for guiding the tray into the gap so as to wedge the tray releasably in the gap and thereby to provide a substantially continuous activity surface. The apparatus can be used to provide a reconfigurable racetrack crossing with the permanent road gap in the racetrack being closeable by means of the movable turf tray. Overlapping edges of the turf tray provide a weight wedging action which provides reliable pressure joins. This also has application for creating reconfigurable turfed activity surfaces such as are used in sports stadia and the like.

82 Claims, 17 Drawing Sheets

FOREIGN PATENT DOCUMENTS

| | | | | |
|---|---|---|---|---|
| DE | 298 07 310 | U1 | | 1/1999 |
| EP | 0 0608 450 | B1 | | 8/1994 |
| EP | 0 555 308 | B1 | | 1/1998 |
| GB | 319472 | | | 9/1929 |
| GB | 1 468 835 | | | 3/1977 |
| GB | 1 546 903 | | | 5/1979 |
| GB | 2 109 843 | A | | 6/1983 |
| GB | 2 138 690 | A | | 10/1984 |
| GB | 2 253 600 | A | | 9/1992 |
| GB | 2 290 239 | A | | 12/1995 |
| GB | 2290239 | A | * | 12/1995 |
| JP | 7048940 | | | 2/1995 |
| JP | 9170347 | | | 6/1997 |
| JP | 10505528 | T | | 6/1998 |
| NL | A 9100495 | | | 10/1992 |
| NL | 9101557 | A | | 4/1993 |
| WO | WO 92/05690 | A | | 4/1992 |
| WO | WO 95/19101 | | | 7/1995 |
| WO | WO 95/33890 | | | 12/1995 |
| WO | WO 95/34208 | | | 12/1995 |
| WO | WO 96/12533 | | | 5/1996 |
| WO | WO 98/57011 | A | | 12/1998 |

* cited by examiner

ACTIVITY SURFACES

The present invention concerns improvements relating to activity surfaces such as racetracks and more particularly, though not exclusively, to a novel method and apparatus for reconfiguring a crossing at a turfed racetrack. The present invention also has utility in replacing worn surfaces of turfed and non-turfed sports surfaces such as pitches and racetracks. Furthermore the present invention also concerns improvements relating to the joining of sections of turfed surfaces together or sections of non-turfed surfaces together.

BACKGROUND

As the populations of our cities and towns increase, so does the need to provide multi-functional venues or stadia where we can watch, play or participate in a variety of sports or other activities. Increasingly these days a sports stadium may double as a football pitch, hockey field and athletics track, whereas the local racecourse also caters for both dog racing and horse racing. In our larger cities, international-standard stadia are used for major sports fixtures, parades, even concerts.

Whilst the design of such multi-purpose venues primarily focuses on the needs of spectators, the wear and tear on the activity surface contained within the venue can be a groundkeeper's nightmare. For a number of sports such as cricket, tennis or football, there is constant pressure to maintain the playing surface in the best condition possible and quite often the ranking of, for example, a football stadium as a fixture will be judged not only on its physical design, but also the quality of its playing surface.

Both single and multi-purpose activity surfaces are subject to wear and tear through use and exposure to the elements. Some areas of an activity surface will wear at a different rate than other areas, and a good example of this is the region in a football pitch around the so called 'six yard box', which often will be worn down before any other part of the pitch. Exposure to the elements further complicates the upkeep of an activity surface and, despite the best endeavours of all concerned, some areas can never be returned to a satisfactory state. Attempts to solve this problem by enclosing the activity surface are not always successful, especially where the activity surface is turfed as the resulting environment may be inhospitable to the turf surface.

In addition, it may be desirable to be able to easily and quickly reconfigure a part or all of an activity surface such that the function of the reconfigured area can be altered. For example, a stadium surface (or a portion of same) could be changed from a turfed surface used for football to an artificial surface used for hockey. Ideally, such a transformation should be able to be effected quickly, and the reconfigured surface as a whole should be as uniform as possible.

Another type of activity surface which is of interest is a racetrack. As racecourses occupy considerable areas, they often have points of the racetrack at which a crossing is provided. The crossing is usually in the form of a road which is used by vehicles for the vast majority of time throughout the year. However, shortly before a race meeting, the crossing is closed to road vehicles and measures are taken to make the tarmac road surface temporarily simulate the natural surface of the racetrack. These measures include placing coconut matting on the tarmac road surface and overlaying this with natural turf. In addition, a running rail of the racetrack is connected across the road for the racehorses' guidance. Once the race meeting is over, the added section of running rail is taken down and the coconut matting and the sections of turf placed thereon are simply removed from the tarmac road surface so that the crossing can be used by road vehicles once again.

Horses racing on the racetrack can be quite sensitive to changes in the 'going' of the racetrack ground. On approaching the crossing, they feel the difference in the way in which the ground deflects under their hoofs. In the past, most horses have simply got used to this difference and though experience they learn how to deal with this change in hardness of the ground so as not to be startled by it. For young horses this has however, always been a problem which causes adverse reaction in the horse's behaviour. For example, some horses try to jump the road and other simply pull up. Recently, some young horses have actually broken their hoofs on the harder road crossing section of the racetrack.

One possible way of overcoming this problem is to make the access via both the road and the racetrack continuous. This can be achieved by building a road tunnel or underpass such that the vehicles can pass under the flat continuous racetrack at the crossing. The major difficulty with this proposal is that of cost. Building such a road tunnel or underpass is extremely expensive and also requires local planning permission to be obtained.

Many attempts have been made to provide systems and methods to allow an activity surface or part of the same to be reconfigured. The most common solution has been to provide a multitude of mobile sections of the activity surface, which are positioned where required and joined together. However, the present inventors have realised that there are a number of disadvantages with existing systems and methods which, for example, make them unsuitable for solving the problems associated with racetrack crossings. Some of these known systems and their known implementations are described below.

Turf moving systems are known for creating turfed sports surfaces such as football pitches. One such system is described in International patent application WO-A-92/05690. This document describes a system in which a plurality of mobile turf units are provided each containing turf growing medium and a turf surface. Each of the units is stored in a growing position and then moved into a stadium and assembled together for use. However, the difficulty with these types of turf moving systems is that the units are designed to be replaceable infrequently, namely that they are semi-permanent. More particularly, once the turf units have been assembled together, the turf and soil at the edges of the turf units are tended to grow as a single continuous surface with the turf roots binding the edges together in a semi-permanent fashion to provide the required integrity of contacting turf unit edges. Accordingly, these types of systems are not designed to be readily reconfigurable. Furthermore, the units' assembly can take a long time as the units have to be physically connected together and then the upper turfed surface constructed by the addition of topsoil and turf.

GB-A-2 138 690 describes a reconfigurable turf tray moving system. A plurality of turf trays are provided, which are mobile by floatation on compressed air, and can be arranged to make up a turfed sports pitch. Each turf tray is provided with a pliable plastics edging which is supposed retain the integrity of the playing surface. However, in practice, as the pliable edging has different deformation characteristics to natural turf and soil, the pliable edging can interfere with the performance of the sports surface. More specifically, a natural turfed soil surface varies in its deformation characteristics with weather conditions. For example, the water content of the soil changes the hardness of the soil with changes in temperature such that the soil can become quite hard with cold frosty weather and can become very soft with relatively warm wet weather. However, the pliable edging used does not have this variation in its deformation characteristics such that in some weather conditions, the performance of the sports surface at the edging is too different to that of the surrounding turf to be acceptable.

Another reconfigurable turf tray moving system is known from International patent application WO-A-95/33890. A utility surface such as a turfed playing surface can be constructed from a plurality of turf trays. Each of the turf trays is provided on air bearings and several such trays can be moved into position to create a turfed sports surface. The edges of the turf trays when mated together are provided below the turfed surface. This is achieved by having pivotable edging which can be raised for providing support of the turf and soil during a growth phase and lowered when the turf tray is to be connected to another turf tray.

The types of turf trays described in WO-A-95/33890 are not suitable for use in reconfigurably closing a gap in a pathway such as a racetrack or, in fact, for reconfigurably closing a gap between any two fixed opposing edges of an activity surface. This is because in order to move a movable tray into its final position within a gap, an excessive amount of rubbing is caused between the edges of the tray and those of the fixed activity surface which leads to an unacceptable amount of wear at the join between the activity surface and that of the tray surface. More specifically, excessive wear can lead to dangerous gaps in the activity surface appearing. Furthermore, the prior art turf tray systems are not designed to be moved frequently and as such there is no appreciation of the problems of maintaining a turf edge which has to be engaged and disengaged from the edges of the activity surface quickly and repetitively without substantial deterioration.

GB 319 472 describes a system in which flat indoor or outdoor tracks and racing surfaces or portions of same are converted to a banked or other type of track by means of portable or removable sections or receptacles. The sections are arranged on top of the original track surface and a new track surface is constructed thereon using the sections, which may be bolted or fixed together to form a complete arrangement of any desired design or form of surface. This type of system is at least semi-permanent and is not suitable for the frequent replacement of a section of the original activity surface. In addition, the resulting arrangement is not able to be removed and replaced relatively quickly, and the construction of the arrangement on top of the original activity surface is likely to damage the latter, which is unacceptable.

U.S. Pat. No. 4,281,831 describes a movable dirt tray which can be used to convert a continuous horse racetrack into a continuous dog racetrack and has particular application where horse racetracks are combined with dog racetracks so that dog races may be held during the period when the horses are not racing. A pair of portable sections for a dog racetrack are provided and positioned relative to fixed sections of the racetrack. Movement of the sections is achieved by providing each section with at least one laterally extending axle which engages with a pair of wide tread rollers or wheels. Each section can be connected to a power plant via a winch and cable system such that when required, the portable sections can be automatically aligned and joined with the fixed sections to form a continuous racetrack. The sections are joined by way of a number of hingedly mounted plates or spans, and any gaps between the sections are filled or covered by sand, silt or other natural or man-made material which forms part of the track surface.

The quality of the activity surface is not suitable for use in relation to turfed activity surfaces or where a seamless join between the sections is required. Furthermore, as with GB 319 472 this system has the disadvantage of not being readily reconfigurable, and the movement of the sections across the horse racetrack may result in damage to same, which is unsatisfactory.

GB-B-2 290 239 describes an element for use in constructing a utility or activity surface, such as a football pitch. To solve the problem of wear and tear on such large surface areas, coupled with exposure to the elements, a tray-shaped member element is used to construct a utility surface. The element has at least one upstanding side wall with a detachable or movable upper portion and a flexible lining disposed within the element. The side wall has an upper portion which is pivotable (foldable) between a raised 'operative' position and a lowered 'inoperative' position. The purpose of this is to secure a retaining structure for the soil filling of the tray during the growth of the turf, particularly at the periphery of the tray, and to provide a continuous turf surface when the elements are put together to form the activity surface. The upper portions of the tray are retained in the operative position whilst the tray is in storage or when it is being transported to or from a storage area. However, the system is not designed to be used for closing a gap as the edge profile of each element would degrade unacceptably if used in this manner. The use of a compressed air source to create a fluid cushion between the tray-shaped member elements and an underlying support surface is also described, by which the elements may be moved from a storage position and positioned as desired to form the activity surface, and a method of forming a games pitch for use using the aforementioned features.

International patent application WO-A-96/12533 refers to turfing systems for stadia and describes a turf unit which has a fence hingeably connected to a growing pan. The outer periphery of the fence extends beyond the outer periphery of the growing pans such that when the turf units are assembled to create a playing surface, large open volumes are created beneath the peripheries of the adjacent growing pans for storing the fence sections and allowing good water drainage of the playing surface. However, an activity surface formed using such turf units is not reconfigurable without damage to the activity surface itself and is also unsuitable for closing a gap in an activity surface.

Accordingly, as mentioned before the existing turf tray moving systems are not suitable for closing a fixed gap in an activity surface and so could not be used as part of a reconfigurable racetrack crossing.

Therefore, it is desired to provide a practical solution to the racetrack crossing problem and also to eliminate or at least substantially reduce the disadvantages of the existing movable activity section systems via the present invention.

SUMMARY OF THE INVENTION

The present invention in one of its broadest aspects resides in the appreciation that there is a viable alternative to the underpass solution. In particular, the present inventors have appreciated that the solution is to use one or more movable turf trays to temporarily reconfigure the crossing for use by the horses rather than the road vehicles. This option is far cheaper than building an underpass.

More specifically, according to one aspect of the present invention there is provided an apparatus for closing a fixed gap in an activity surface, the apparatus comprising a movable tray having an upper surface with the same characteristics as the activity surface and means for guiding the tray into the gap so as to wedge the tray releasably in the gap and thereby to provide at least temporarily a substantially continuous activity surface.

The term 'activity surface' is intended to mean any surface for an activity where the uniformity of the surface and hence its constant and consistent performance is important. Examples of such surfaces used for sports are a racetrack, a sports pitch and an athletics track with either an artificial or natural surface.

Preferably the activity surface comprises a pathway. The term 'pathway' means an elongate directional activity surface such as a racecourse or an athletics track.

Preferably, the apparatus is arranged to reopen the gap by disengaging the movable tray from the gap and the guiding means is arranged to guide the tray out of the gap away from the activity surface. This is preferable in that it allows the gap to be closed or reopened relatively quickly such that the condition of the activity surface, such as a pathway, can be changed relatively quickly. For example, this would allow the apparatus to function as a reconfigurable racetrack crossing.

More particularly, the present invention has a particular application to turfed activity surfaces. Accordingly, the movable tray preferably comprises a turfed upper surface.

Preferably in the apparatus according to the present invention, the turf of both the activity surface and the movable tray is provided on a layer of topsoil having a minimum depth of 150 mm, such that when tray is wedged in the gap, a continuous layer of topsoil is formed having a minimum depth of 150 mm.

The upper surface of the movable tray is preferably arranged to have substantially the same coefficient of deformation as that of the pathway such that when the tray is wedged in the gap, the resultant continuous pathway has a substantially uniform coefficient of deformation. The advantage of this is that if the activity surface is subjected to heavy impacts, such as that of horses hoofs, then the movable section of the pathway in the form of the tray will not be detectable to the horse as it responds in exactly the same way as the other areas of the activity surface surrounding it. In particular, this is of most importance at the edges of the movable tray where edge maintaining measures may be employed.

The movable tray may comprise a base and upstanding side walls, the side walls comprising substantially vertical portions and upper portions provided at an angle to the vertical. By providing the upper portions at an angle, it is possible to minimise the contact surface between the tray and the edges of the racetrack at the gap. This advantageously maximises the pressure applied at the contact surfaces of the tray and the racetrack edge and ensures a secure joint. Another advantage over a fully inclined edge is that when the gap is open, there is less of a horizontal distance between the ends of the sloping edge. This can be particularly useful at a crossing where the substantially vertical portion of the racetrack edge can protect the upper inclined mating edge from damage due to vehicles running off the road into the edges of the racetrack at the gap, for example.

The tray may further comprise an edging material and a soil filling, the edging material and soil filling being arranged to provide a tray edge which extends beyond the upper portion of the side walls at the same angle to the vertical as the upper portion of the side wall. The edging material provides support for the all important upper edge region. This is advantageous in increasing the length of time that the edge can be maintained in optimum condition without requiring intensive maintenance. Furthermore, as the edging material is very flexible, it does not alter the coefficient of deformation of the pathway when the tray is coupled to the edges of the pathway.

Preferably, the movable tray comprises a plurality of movable trays for closing the gap with at least one of the trays being arranged to exert a wedging action in the gap.

In other embodiments of the present invention, the edge profiles of the pathway at the gap and of the movable tray comprise complimentary wedge shapes as viewed in a vertical or horizontal plane, or complimentary curved wedge shapes as viewed in a horizontal plane.

The wedging action is important in providing a secure final fit of the movable turf tray in the gap, and the importance of this fit cannot be underestimated. In order for the activity surface to be safe for animals and humans alike to use, the edges of the tray and the pathway need to be well matched without any noticeable gaps. Such gaps could not only adversely affect the activity being performed on the surface, but also may cause the user to trip and fall. Furthermore, as the contact surfaces will inevitably wear with time, the use of a wedging action advantageously enables the mating of the contact surfaces to be maintained despite the wear. This is simply achieved by driving the wedge further to close any gaps that arise through wear. Furthermore, the provision of a wedging action enables the contact surfaces to be held together in a pressure join thereby minimising any weakness in the join. The advantage of this is that if the activity surface is subjected to heavy impacts, such as that of horses hoofs, then the movable section of the pathway in the form of the tray will not be detectable to the horse as it responses in exactly the same way as the other areas of the activity surface surrounding it. In particular, this is of most importance at the edges of the movable tray where edge maintaining measures may be employed.

It is to be appreciated that the wedging can be effected as vertical wedging where the wedging movement is carried out in a vertical direction using the weight of the movable tray to secure the tray in position. Also, the wedging can be carried out as horizontal wedging where the wedging movement is carried out in a horizontal direction. Horizontal wedging simplifies the movement of the tray in that the tray does not need to be lifted and can be maintained in a constant horizontal plane.

The apparatus may further comprise a support platform for the movable tray, which itself comprises a plurality of diagonal support members arranged in groups, each group being arranged to focus the weight of a region of the tray to a single location. This advantageously provides a set of points at which the whole weight of the tray can be supported. This provides a particularly effective and balanced way of supporting large trays on a movement system such as a set of wheels and guide rails or air bearings when either of these is provided with the movable tray.

Preferably, the guide rails are curved to facilitate the movement of the support platform and tray into and out of the gap. More preferably, the whole system is movable automatically and the movement system comprises electric drive motors, the motors being pulse controlled such that the rate of movement and positioning of the platform can be varied and controlled accurately. The movement system preferably further comprises a digital controller for controlling the movement of the platform and tray via the electric drive motors. This automatic and variable control of the tray ensures ease of use and enables the relatively fast movement required to reconfigure a crossing for example.

Preferably, the movement system comprises means for raising and lowering the platform and tray. This allows adjustments to the lateral alignment of the tray to be made before final positioning. More specifically, when the movable tray approaches the gap, it is centrally guided to ensure that the gaps between the tray and the edges of the pathway at the gap are equal. Because of this, the platform can then be lowered relatively quickly with the confidence that the action of wedging the tray between the edges of the pathway will not result in an excessive amount of wear between the contact surfaces.

The raising and lowering means comprise a set of hydraulic actuators acting on respective over-centre pivot arms, each over-centre pivot arm being connected to a wheel of the set of wheels. Advantageously, the raising and lowering means comprises a manual override means including a hand pump to enabling the raising and lowering to be effected manually, which is especially useful in emergency situations.

The guiding means may be arranged to move the tray such that edges of the tray move into engagement with edges of the pathway at the gap at an angle to the plane in which at least the upper portions of the edges of the pathway at the gap are provided. This advantageously minimises the degree of contact between the edges thereby minimising the amount of wear between the contact surfaces.

All of the above can be provided on a railed system such that the movement of the tray is readily controllable. The use of a railed system means that extremely heavy and large trays can be used in the system without difficulty, and there are obvious advantages in being able to move very heavy loads with consummate ease. Trays weighing thousands of tons in weight can be moved on railed movement apparatus. In addition, this way of moving trays advantageously enables both the vertical and horizontal movement of the tray to be carried out relatively easily, with a high level of control. Such results are not so easily obtainable where the trays are carried using (non-railed) wheeled systems, particularly as the ability to control effectively the direction and movement of a wheeled system decreases as the weight of the load carried increases. Using a railed system eliminates such difficulties. Another advantage of using a railed system arises when the movement system driving the platform fails. In such circumstances, a towing line may be attached to the platform allowing another vehicle such as a tractor or the like to tow the platform out of the gap or, if the platform is to be positioned in the gap, the platform can be shunted into position accordingly. As a result, in emergency situations where the movement system has failed, the platform can be moved with minimum effort to either open or close the gap in the pathway.

According to another aspect of the present invention, there is provided a method of closing a fixed gap in an activity surface, the method comprising providing a movable tray having an upper surface with the same characteristics as the activity surface and guiding the tray into the gap so as to wedge the same releasably in the gap to close the same.

The present invention also extends to a reconfigurable racetrack crossing incorporating an apparatus as described above and to a method of closing a reconfigurable racetrack crossing comprising a method described above.

According to another aspect of the present invention there is provided a method of reconfigurably joining a first section of an activity surface provided in a movable tray to a second section of the activity surface, the method comprising providing complimentary overlapping edges which are inclined to the vertical on both of the sections of the activity surface, moving the movable tray with the first section into a position adjacent the second section and abutting the first section into contact with the second section along the inclined edge to reconfigurably join the two sections together.

The provision of overlapping edges provides a simple reliable join between the sections which overcomes the problems of wear at joins between the sections.

According to another aspect of the present invention there is provided a reconfigurable activity surface comprising a plurality of sections, a first one of the sections being provided in a movable tray that can be moved into engagement with a second one of the sections to form at least a portion of the activity surface, the first section comprising an overlapping edge which is inclined to the vertical and complimentary with a corresponding edge of the second section, such that the first section can be joined to be apparently seamless with the second section.

The term 'overlapping' simply means that one of the edges overlaps the other complimentary edge. The above provides a reliable pressure joint between the two sections. More particularly, when one section is a turf tray and the other section is a racetrack with a pit and surrounding turf, a pit wall and the turf tray edge are preferably both angled at 22.5° (though other angles can also be utilised) to the vertical so that the tray forms a wedge in the pit. This allows a clearance gap between the turf of the turf tray and the surrounding turf to be created by simply lifting the turf tray irrespective of the size of the engagement surface. The advantage of this is that there is next to no rubbing between the engagement surfaces thereby preserving the integrity of the turf edges of both the racetrack and the turf tray. Furthermore, the angular jointing is such that it advantageously enables a reliable pressure joint to be formed between the two engaging surfaces.

The present invention further extends to a reconfigurable movable tray apparatus comprising a plurality of movable trays each providing a part of an activity surface and a set of guide rails wherein the trays are provided with engaging wheels which enable the trays to be movable on the guide rails to a desired coupling position and be securely located at the coupling position by transferring the weight of the tray from the guide wheels to fixed support means of the tray.

This tray system also is preferably operable in the opposite sense namely, that from the secure coupling position, the weight of the tray can be transferred to the wheels and the tray can then be moved on the rails via the wheels to the original start position.

Here, the tray can be parked as before at the desired coupling position.

Referring now to FIG. 11*a*, another problem with racetracks 304 and turfed stadia is described. Steeplechase racing involves horses racing around a racetrack 304 and jumping fences 312. The areas 320 of turf just after each jump 312 are subjected to heavy wear because of the repeated impact of horses landing after their jumps. Similarly, the goal mouths of football pitches are also subjected to heavy wear. Maintaining these areas of turf at the same condition as the rest of the racetrack 304 or pitch is a problem because it takes time to regrow the turf. However, by use of removable turf sections employing the present invention, these problems can be overcome.

More particularly, the present invention also extends to a replaceable section of an activity surface, the section being provided on a reconfigurable movable tray and being arranged to disengage the activity surface and be moved away therefrom to be replaced by another section of the activity surface provided on the movable tray. In this way, as a section becomes worn it can be replaced relatively easily.

All of the above can be provided on a railed system such that the movement of the tray is readily controllable. The advantages of using a railed system have been discussed previously.

According to another aspect of the present invention there is provided a reconfigurable tray moving apparatus for constructing part of a reconfigurable activity surface, the apparatus comprising a set of guide rails and at least one tray providing part of the activity surface, which is movable on the rails, the apparatus further comprising means for moving the at least one tray laterally with respect to the direction of travel of the tray on the rails in order to effect alignment of the tray with an edge of the activity surface.

Such alignment becomes more and more important as the size of the tray increases. Also such alignment minimises the amount of wear on the edges of the tray and sides.

BRIEF DESCRIPTION OF THE DRAWINGS

Preferred embodiments of the present invention will now be described by way of example with reference to the accompanying drawings. In the drawings.

DETAILED DESCRIPTION

Figure 1:
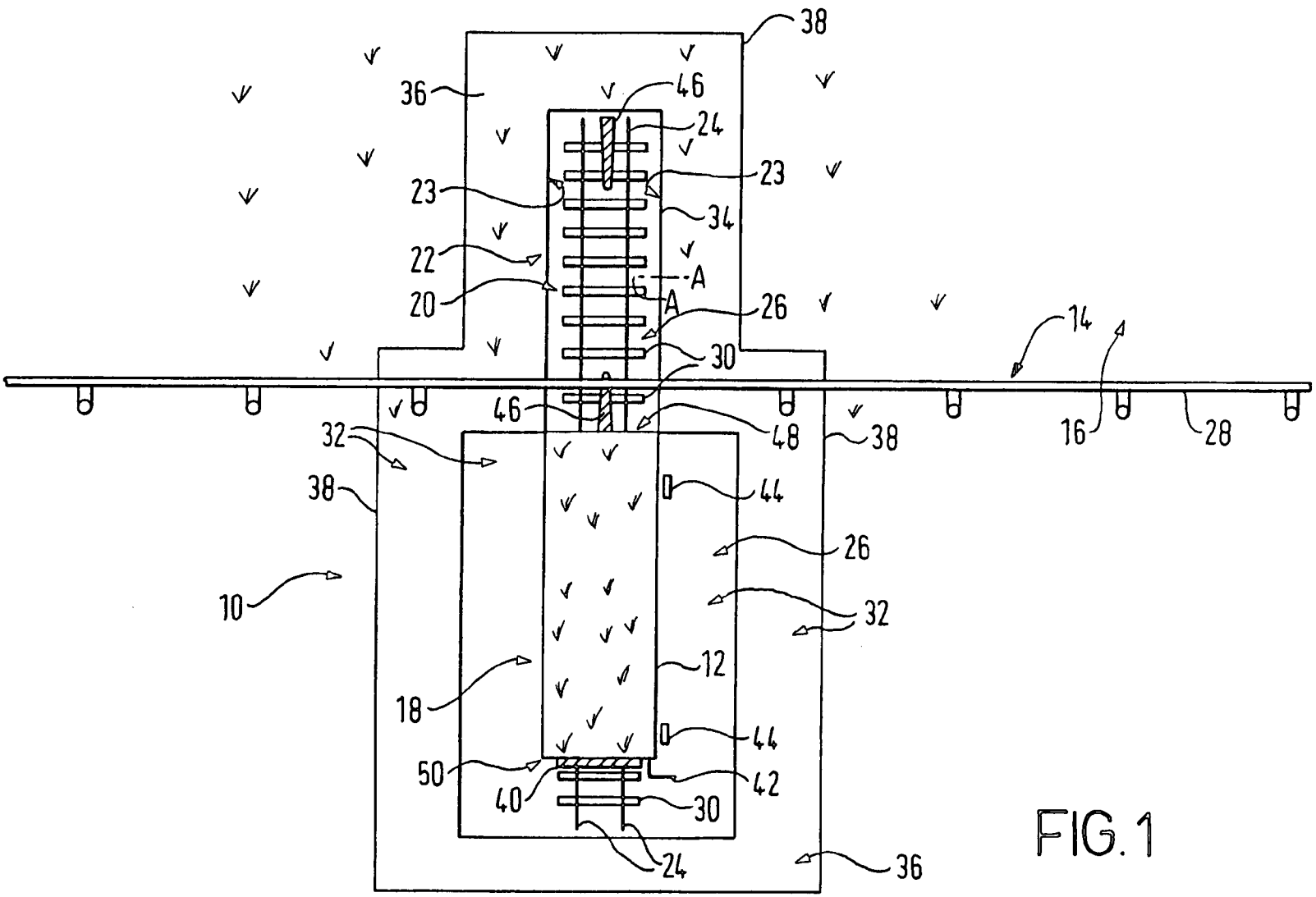
FIG. 1 is a schematic plan view of a turf tray moving system in a non-race (open) mode according to a first embodiment of the present invention.
Figure 2:
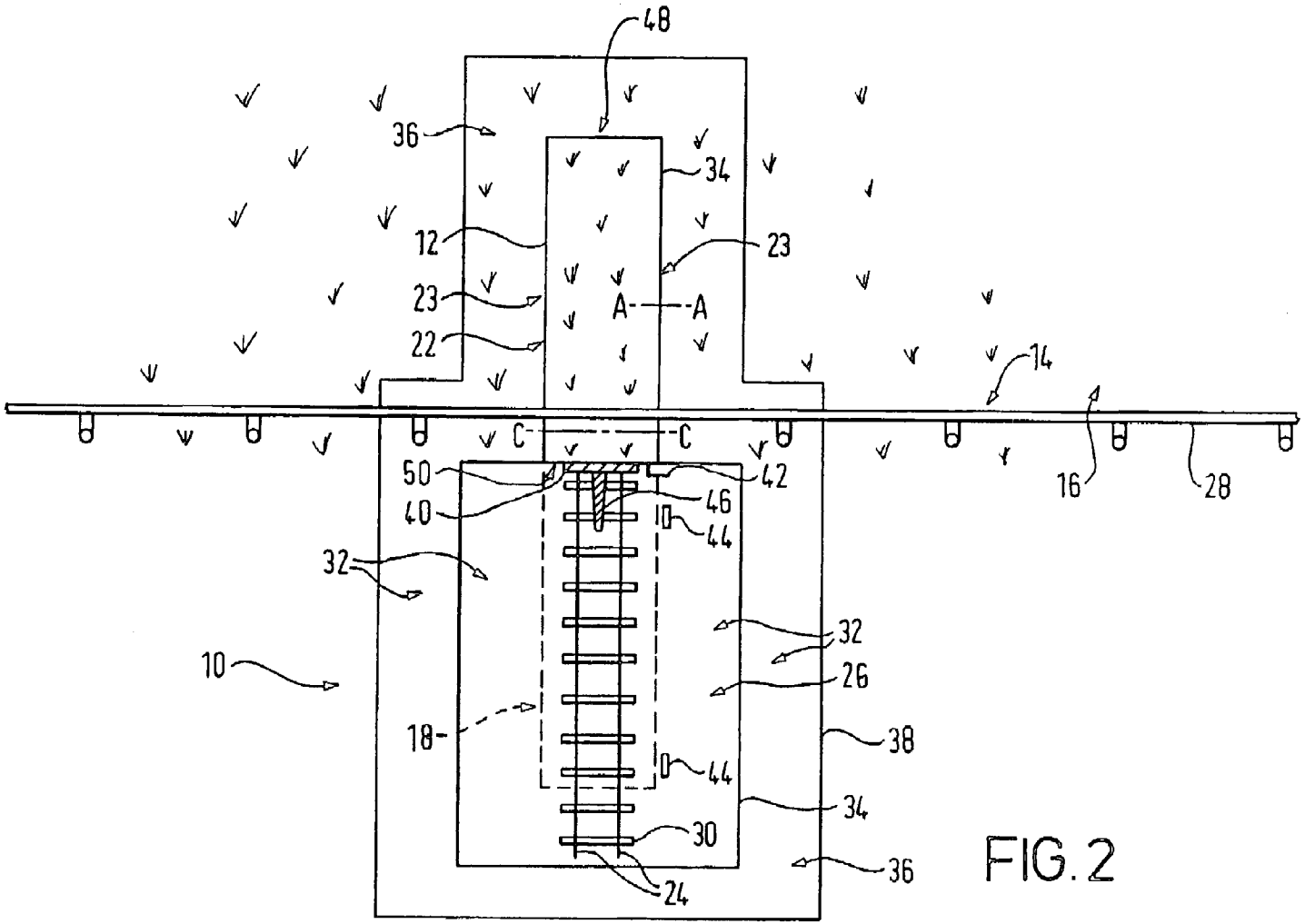
FIG. 2 is a schematic plan view of the turf tray moving system of FIG. 1 in a race (closed) mode.

Referring now to FIGS. 1 and 2, a turf tray moving system 10 of a first embodiment of the present invention comprises a movable turf tray 12 which is arranged to be movable, substantially at right angles to an edge 14 of a racetrack 16, between two locations each representing a different racetrack mode. In a non-race (open) mode, the turf tray 12, at a first location 18 (FIG. 1), is spaced apart from a gap 20 in the turfed racetrack 16. In a race (closed) mode, the turf tray 12 at the second location 22 (FIG. 2), is adjoined to edges 23 of the racetrack 12 which define the gap 20 and accordingly fills the gap 20. In this embodiment, the turf tray 12 is provided on a wheeled platform (see FIGS. 5*a* to 5*d* and 6*a* to 6*d*) and is movable between the first and second locations 18, 22 by way of guide rails 24.

The turf tray moving system 10 is provided within an excavated pit 26 which partially overlaps a portion of the racetrack 12 (the edge 14 of the racetrack 12 being defined by a running rail 28). The base of the pit 26 is levelled with a layer of compacted stone which provides a horizontal surface on which to provide the guide rails 24. The guide rails 24 are supported on steel sleepers 30 which extend across the width of the excavated pit 26 (the limits of extension are not shown in FIGS. 1 and 2). The excavated pit 26 is positioned within a larger area of excavation 32 which enables specific characteristics to be imparted to the pit walls 34. The pit wall construction is described in detail later with reference to FIG. 3. The region 36 between the limit of excavation 38 and the pit walls 34 are filled and provide a continuous substantially uniform turfed racing surface on the racetrack 16 up to the pit walls 34.

The turf tray 12 is moved by an electric drive mechanism which powers the wheels of the platform. The speed and timing of movement is controlled by a controller 40 which is provided at one end of the turf tray 12 and platform. When the platform is at one of the first and second locations 18, 22, the controller 40 ensures that the movement is at a relatively slow speed. However between the first and second locations 18, 22, the speed of movement is faster. In order for the controller 40 to know when to speed up or slow down the movement, the platform is provided with a proximity sensor 42. Two markers 44 are provided at predetermined distances from the first and second locations 18, 22. The sensor 42 detects when the platform has reached a marker 44 and informs the controller 40 that the platform is a predetermined distance from the first or second location 18, 22. At this stage, the controller 40 either reduces the speed of the movement for final positioning of the turf tray 12 at the end of its travel or increases the speed of movement after the initial slow movement at the beginning of its travel.

The electric power required to control the movement of the platform and turf tray 12 is provided by a mobile single-phase 240V AC petrol generator (not shown). The generator is provided in the excavated pit 26 and the power is supplied to the platform via power cables (not shown). However, it could by powered by various other power sources, for example a single-phase 110V AC power supply, a three-phase 110V AC power supply, a three-phase 240V AC power supply, a three-phase 415V AC power supply, a 110V DC power supply or a 240V DC power supply.

The turf tray 12 and a surrounding pit wall 34 have complementary engagement edges. These edges are provided at an angle of 22.50 to the vertical and enable a reliable pressure join to be formed between the turf of the racetrack 16 and that of the turf tray 12. Whilst other angles could be used to also provide a reliable join, the angle of 22.5° is presently preferred. In this embodiment, the separation and engagement of these complementary surfaces is carried out by vertical raising and lowering of the turf tray 12. In order to prevent rubbing of the edges of the turf tray 12 and the pit walls 34, which could damage the uniformity of the turf edges, the turf tray 12 is always raised prior to movement between the first and second locations 18, 22. Typically, the tray 12 is raised by about 50 mm. The mechanism used for movement of the tray 12 both vertically and horizontally, is described in greater detail later with reference to FIGS. 5*a* to 5*d* and 6*a* to 6*d*.

The system 10 also includes aligning wedge blocks 46 for aligning the turf tray 12 and platform at the second location 22 to ensure that the edges of the turf tray 12 and the racetrack gap 20 are in alignment. One alignment wedge block 46 is positioned to engage a leading end 48 of the platform and the other wedge block 46 is positioned to engage a trailing end 50. The platform is provided with an adjustable guidance unit at each of the leading and trailing ends 48,50. Each guidance unit has buffer wheels which engage the sides of the wedge blocks 46 to alter the lateral alignment of the platform if necessary. In order for the platform to be movable laterally on the guide rails 30, the wheels of the platform are slightly oversized in width with respect to the width of the guide rails 30.

Figure 3:
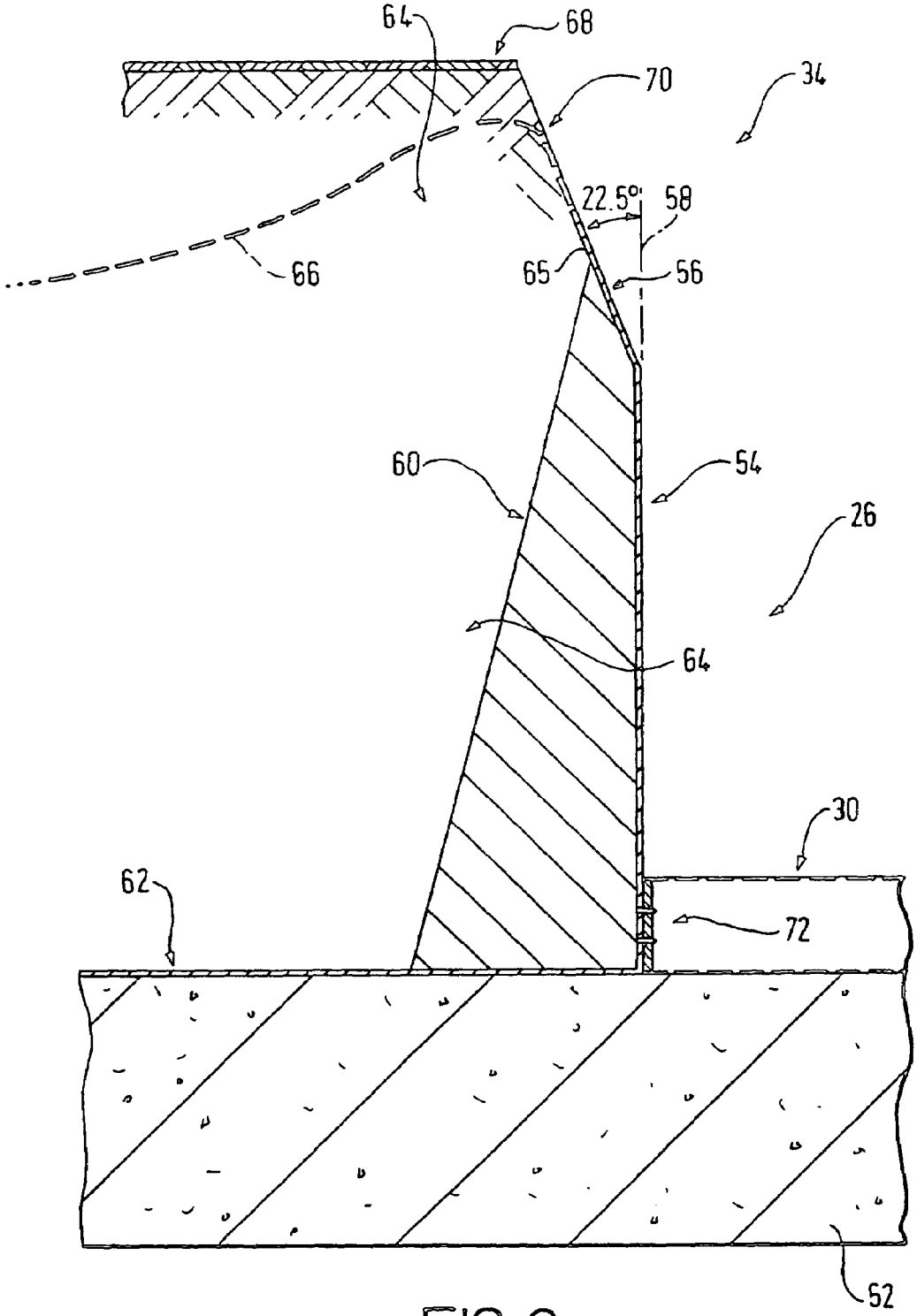
FIG. 3 is a schematic cross-sectional view of a section through AA of FIG. 1 showing the configuration of a pit wall.

Referring now to FIG. 3, the construction of the pit walls 34 is now described in greater detail. The base of the pit 26 is levelled with the layer of compacted stone 52 and this extends partially into the region 36 between the pit wall 34 and the limit of excavation 38 so that the pit wall 34 can be erected on this horizontal base surface.

The pit wall 34 comprises a steel plate 54 which when erected is vertical along most of its height but has an upper end 56 which is angled at 22.5° to the vertical 58 away from the pit 26. The vertical steel plate 52 is supported by a series of spaced apart counterforts (buttresses) 60. A horizontal steel base plate 62 is also provided for supporting the counterforts 60.

The surrounding region 36 of the excavated area around the pit wall 34 is filled with soil 64 from the excavated area up to the top edge of the steel plate portion 54 of the pit wall 34. In order to extend the level of the soil 64 to that of the racetrack 16, a flexible edge reinforcement material 66 (such as VHAF™ edging material) is provided for retaining the soil 64 and turf 68 together above the height of the top edge of the steel plate portion 54 of the pit wall 34. The flexible edge reinforcement material 66 is synthetic grass material which is porous and has a similar coefficient of deformation as that of turf 68 and soil 64.

The edging material 66 is positioned to extend from the top of the vertical part of the steel plate portion 54 of the pit wall 34, along and beyond its angled portion 56, and back over into the soil 64 towards the limit of excavation 38. In this way, the edging material 66 is anchored in the soil 64 and provides support for an angled soil and turf edge 70 which is a continuation of the angled portion 56 of the steel plate portion 54 of the pit wall 34. In the present embodiment, the turfed surface 68 is 150 mm above the top of the angled portion 56 of the steel plate portion 54 of the pit wall. The reason for having this spacing is to allow the turfed surface 68 to distort in a manner similar to that of a natural turfed racetrack surface when a horse's hoof impacts the surface in the region of the angled turf and soil edge 70. The surrounding region 36 is filled and levelled with topsoil having an upper turf surface similar to that of a racetrack turf surface.

The steel sleepers 30 which extend across the width of the excavated pit 26 rest on the compacted stone layer 52 and are bolted and welded to the lowest portion of the steel plate portion 54 of the pit wall 34. This provides sufficient rigid support for the sleepers 30 to enable them to support the significant weight of the turf tray 12 without distortion or flexing particularly when there is movement of the turf tray 12, thereby ensuring that the tray 12 is kept horizontal during its use.

Figure 4:
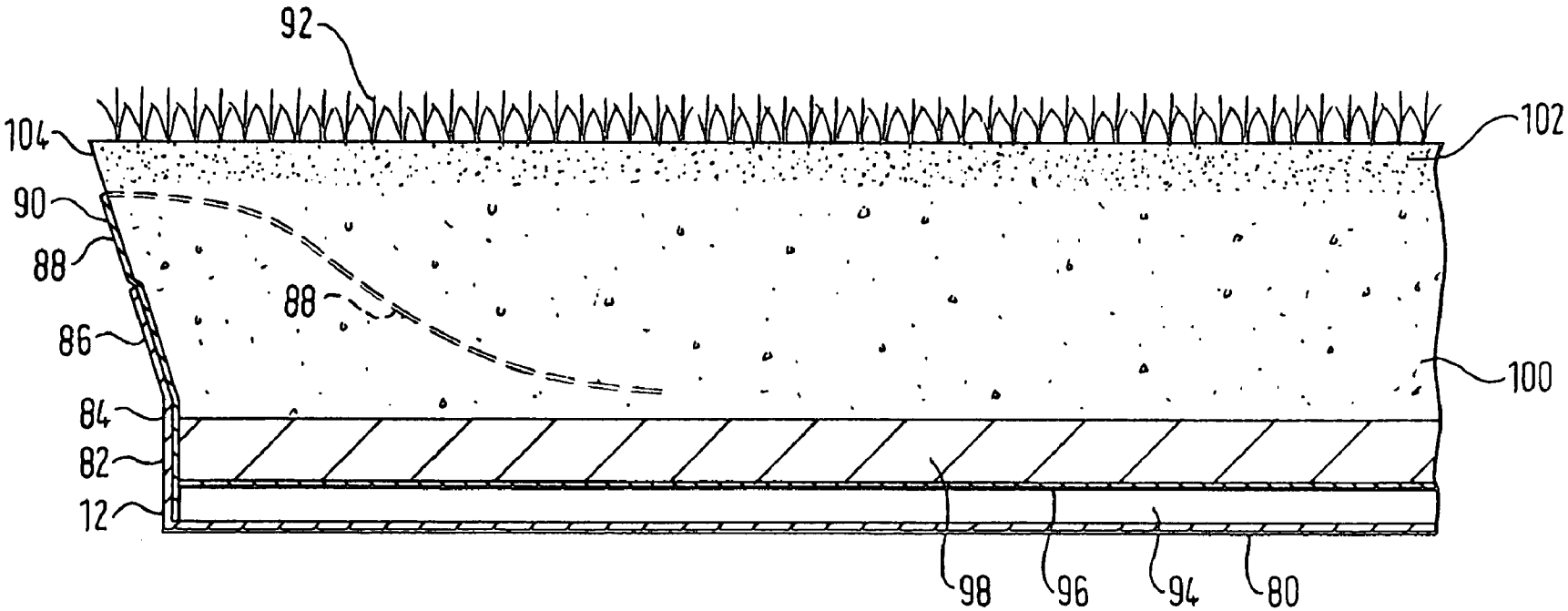
FIG. 4 is a schematic cross-sectional view of a section through the turf tray of FIG. 1 showing the arrangement of the tray and its turf growing contents.
Figure 5A:
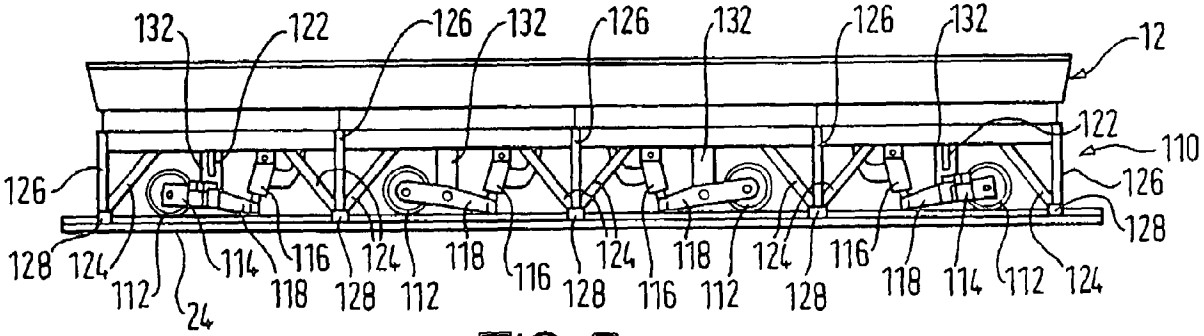
FIG. 5*a* is a side view of the turf tray and moving platform of FIG. 1 showing the moving and lifting mechanisms employed in the platform.
Figure 5B:
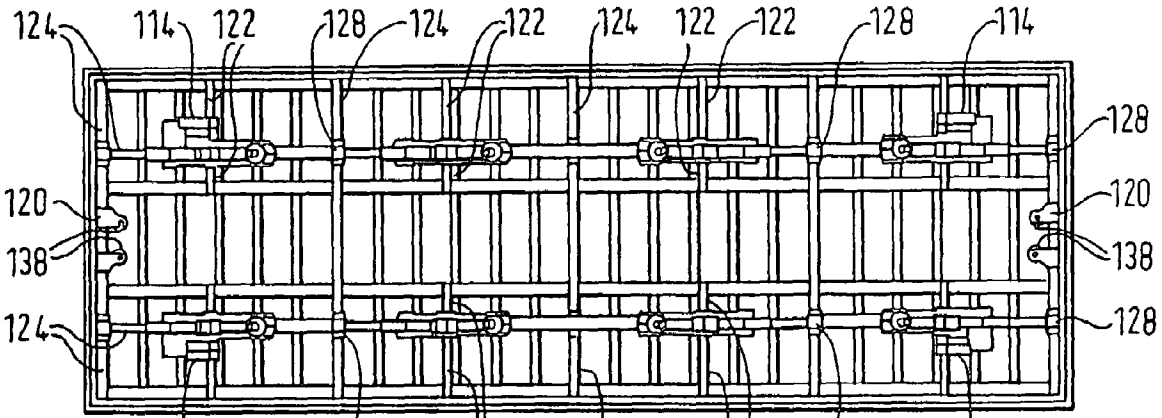
FIG. 5*b* is a plan underside view of the moving platform of FIG. 5*a* showing the moving, lifting and guiding mechanisms employed in the platform.
Figure 5D:
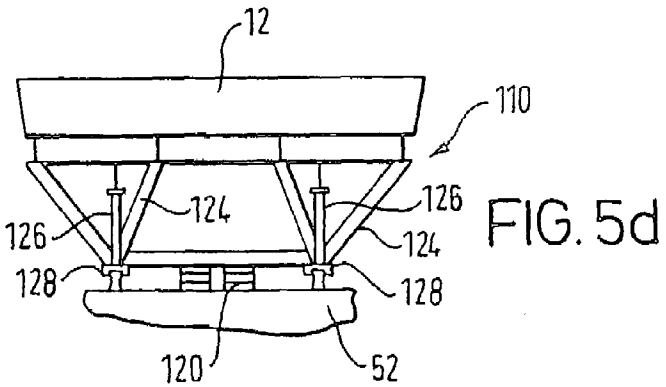
FIG. 5*d* is a cross-sectional view of the turf tray and moving platform of FIG. 5*a* taken at line BB showing the structure of the platform's support legs and diagonal braces.
Figure 5C:
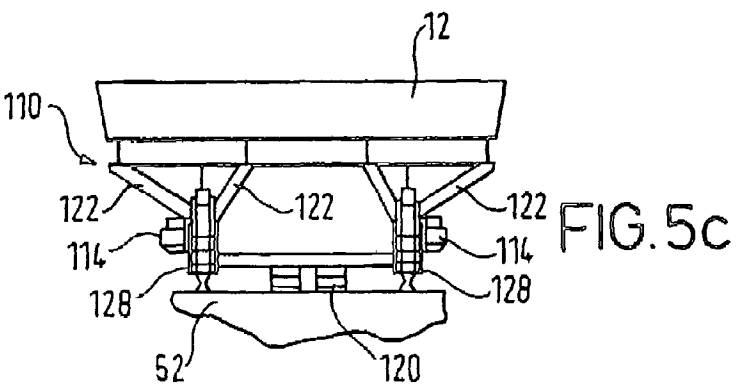
FIG. 5*c* is a cross-sectional view of the turf tray and moving platform of FIG. 5*a* taken at line AA showing the moving, lifting and guiding mechanisms employed in the platform.

FIG. 4 shows a profile of the turf tray 12 without the wheeled platform. The tray 12 comprises a rectangular base 80 with upstanding side walls 82, though only one is shown in FIG. 4. The side walls 82 have a vertical portion 84 and an angled portion 86 which extends beyond the vertical portion 82 at an angle of 22.5° to the vertical. The angled portion 86 provides a guide for a flexible edge reinforcement material 88 which is located adjacent the side wall 82 and extends beyond it to form an angled edge 90 of the tray 12 at an angle of 22.5° to the vertical. The edging material 88 extends and is folded back into the middle of the tray 12 in a similar manner to the edging material 66 of the pit wall construction as described previously. The angled edge 90 thus formed is complementary to that of the pit wall 34.

The tray 12 is provided with several layers of material which enable turf 92 to be grown on the upper surface of the tray 12 in a manner similar to that of a racetrack 16. More specifically, the turf tray 12 comprises a drainage grid 94 provided on the bottom of the tray 12. The drainage grid 94 allows excess water to be drained off out of the tray 12. The drainage grid 94 is overlaid with a plastic mesh 96 (a Netlon plastic mesh in this embodiment) and a layer of Lytag 98. The Lytag 98 provides a coarse aggregate for excess water drainage and the plastic mesh 96 simply prevents the coarse aggregate from being washed down into the drainage grid 94. A relatively thick layer of moisture retaining topsoil 100 is provided as a rooting medium above the Lytag layer 98. Medium fine sand is worked into the surface of the topsoil 100 surface to provide an uppermost growing medium layer 102 on which the turf layer 92 is provided.

Referring to FIGS. 5*a* to 5*d* and 6*a* to 6*d*, the wheeled platform 110 is now described in greater detail. The platform 110 essentially comprises a support framework, a lifting arrangement for raising and lowering the platform 110, a drive mechanism for moving the platform 110 along guide rails 24, and a guidance system for aligning the platform 110 in relation to the guide rails 24. The drive mechanism consists of eight wheels 112, four of which are driven by electric drive motors 114. The lifting arrangement comprises eight double acting hydraulic cylinders 116 which act via a pivot arm 118 on respective wheels 112 to engage or disengage them from the guide rails 24 and also to raise or lower the platform 110 with respect to the guide rails 24. The guidance system comprises two wheeled assemblies 120 at either end of the platform 110. These components are now described in greater detail below.

The framework of the platform 110 has been designed using a computer based stress analysis program. It has been designed to be extremely rigid without the use of excessive amounts of steelwork therefore keeping the weight to a minimum. Cleverly positioned diagonal supports 122 and diagonal braces 124 ensure that large areas of the turf tray 12 are supported by ten support legs 126, namely ten single nodes. By building the hydraulic cylinders 116 into the framework the overall height of the platform 110 is kept to a minimum.

The platform's mass is distributed through the support legs 126 and diagonal braces 124 down to ten evenly spaced 'c' shaped pads 128 which sit on top of the guide rails 24. Each pad 128 is provided at the end of a corresponding support leg 126. Each pad 128 can be adjusted with packers (not shown) to ensure that any height discrepancies between them are removed and the correct overall height is achieved.

Figure 6B:
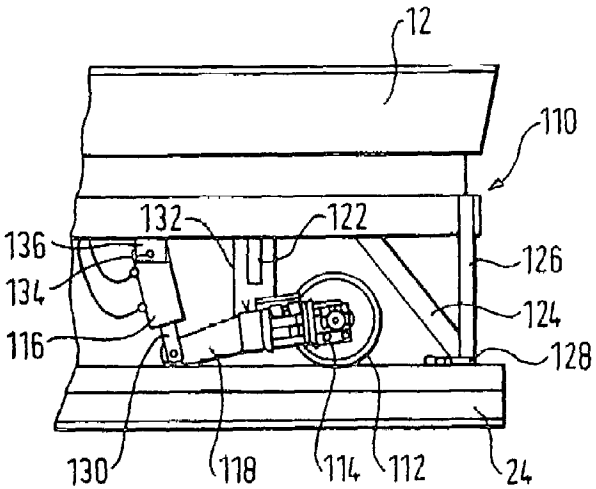
FIG. 6*b* is an enlarged partial view of FIG. 5*a* showing the hydraulic pivoting mechanism of the platform in a lowered condition.
Figure 6A:
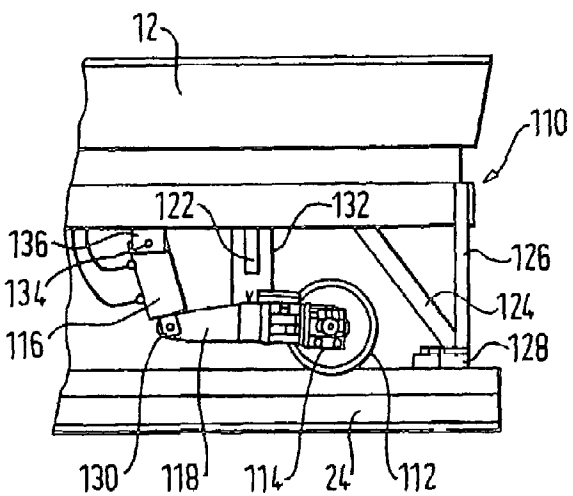
FIG. 6*a* is an enlarged partial view of FIG. 5*a* showing a hydraulic pivoting mechanism of the platform in a raised condition.
Figure 6C:
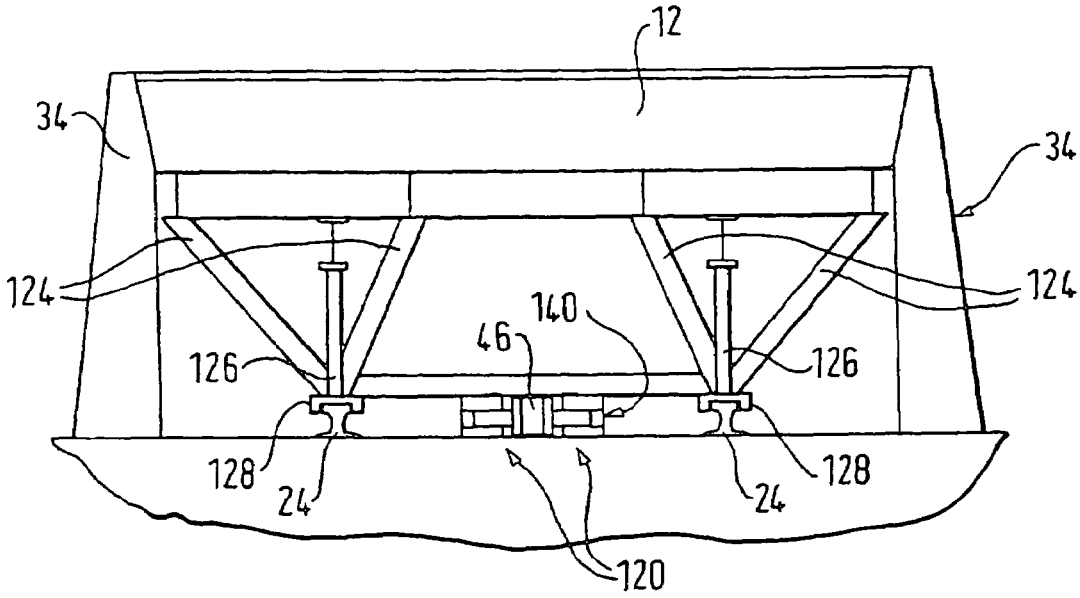
FIG. 6*c* is a cross-sectional view of the moving platform and turf tray of FIG. 2 taken at Line CC showing the turf tray in a lowered condition mating with the racetrack edges.
Figure 6D:
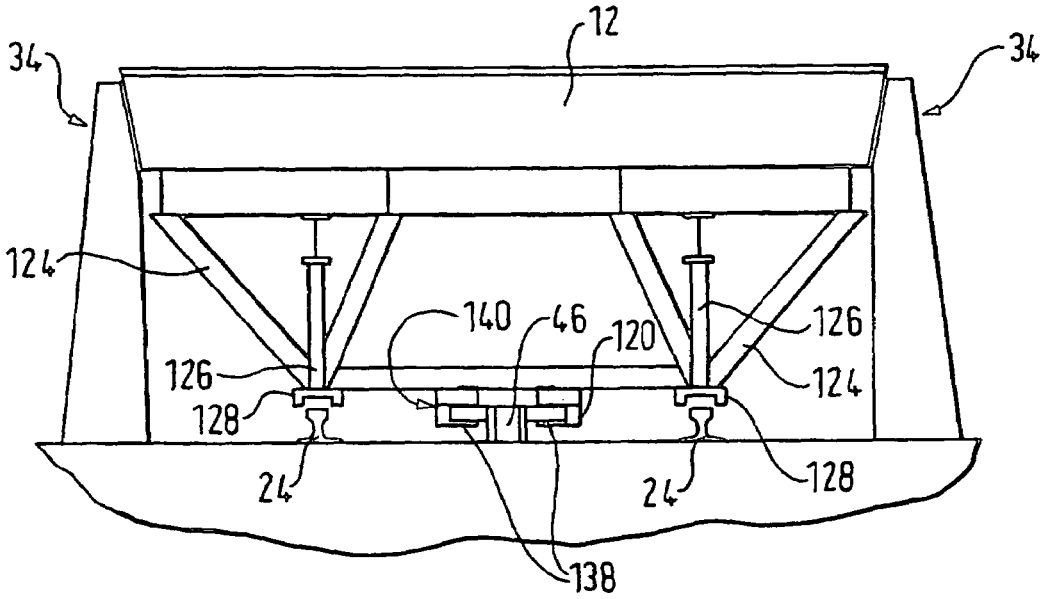
FIG. 6*d* is a cross-sectional view of the moving platform and turf tray of FIG. 2 taken at Line CC showing the turf tray in a raised condition separated from the racetrack edges.

As mentioned earlier, it is essential that the platform 110 is raised prior to any horizontal motion taking place in order to ensure that the turf edges 70, 104 do not rub against each other. Referring now specifically to FIGS. 6*a* to 6*d*, the platform 110 is raised from rest and the mass is gradually transferred from the 'c' shaped pads 128 to the eight evenly spaced wheels 112 by means of a hydraulic pivoting mechanism 116, 118. FIGS. 6*b* and 6*c* show the lifting arrangement and the platform 110 in a lowered configuration and FIGS. 6*a* and 6*d* show the lifting arrangement and platform 110 in a raised condition. In particular, FIG. 6*c* illustrates the vertical wedging action of the turf tray 12 between the sides of the racetrack 16 which define the gap 20. This wedging action is one of the key features to securing a reliable continuous join between the edges of the racetrack and the edges of the turf tray 12.

The eight hydraulic pivoting mechanisms 116, 118 provide the lifting points of the lifting arrangement. Each one of these mechanisms 116, 118 utilises acting hydraulic cylinder 116 which is trunnion mounted within the platform framework with a rod end clevis 130 mounted to one end of a corresponding pivot arm 118. Each wheel 112, which has a double flanged construction, is located at the opposite end of the pivot arm 118. The pivot arm 118 is mounted centrally to a pivot support 132 to ensure a one to one lift ratio. Each pivoting mechanism 116, 118 can be adjusted to ensure that all the wheels 112 are in contact with the guide rails 24 when raised. This is achieved by mounting cylinder trunnion shafts 134 of the cylinders 116 into eccentric pads 136 which can be mounted in six positions to give six slightly different height positions spread over a fifteen millimeter range.

The platform 110 is raised and lowered evenly at all times. A flow divider (not shown) is used to distribute the hydraulic fluid to each of the eight hydraulic cylinders 116 equally. This provides equal lift and lowering of the platform 110 which ensures that the turf 92 on the tray 12 mates with the surrounding turf 68 of the racetrack 16 precisely with exceptional repeatability.

The four outermost wheels 112 are driven using inverter controlled geared motors 114. The inverter (not shown) allows the motor speed to be accurately controlled from extremely low speeds such as 1 Hz up to 50 Hz which equates to a lowest speed of around 1 mm/sec up to a maximum speed of around 50 mm/sec. This could even be increased with different motors which would allow 87 Hz and therefore a maximum speed of around 87 mm/sec (5.22 m/min). Even higher speeds of up to 15 m/min can be achieved by adjusting the gear ratio or wheel diameter, thought this is not required in the present embodiment. The inverter has full control of each motor 114 in unison to ensure that the speeds are constantly matched.

The controller 40 (see FIGS. 1 and 2) comprises a PLC (programmable logic controller) for controlling the movement of the platform 110 via the electric motors 114. The PLC is also linked to a combination of limit switches (not shown) and proximity sensors 42. The operation of the proximity sensors 42 as previously described is to increase or decrease the speed of movement of the platform 110 at the ends of its travel to ensure safe operation. In this embodiment, the last 300 mm of travel is the slow speed region which is passed through before the platform 110 automatically stops at the correct end of travel position. In addition, the limit switches are provided to prevent the platform 110 from being driven horizontally until it is fully raised so as to prevent damage to the mating turf edges 70, 104.

The controller 40 also incorporates a hydraulic power pack (not shown) which controls the operation of the hydraulic cylinders 116 of the lifting mechanism. The hydraulic power pack has a manual pump which can be operated to raise or lower the platform in the event of the hydraulic power pack failure. A solenoid valve on the hydraulic power pack also has a manual override included so that it is possible to manually switch between raise and lower conditions. The manual pump is removable to prevent tampering. The PLC also controls the timing of operation of the hydraulic power pack and the cylinders 116.

The drive mechanism is operated remotely by a user via the controller 40 with a pendant control on a flying lead (not shown). This can be quickly and easily removed when not in use. The pendant controls are Up, Down, Forward, Reverse and Emergency Stop.

As mentioned previously, the guidance system comprises two adjustable guide units 120, one at each end of the platform 110, which house respective wheel assemblies each having two guide wheels 138. The guide wheels 138 of each unit 120 are positioned in use to sit around the guide block 46 mounted in the pit floor 52 when the platform 110 is at the second location 22. The guide blocks 46 are tapered in the direction of turf tray 12 travel so that as the tray 12 moves and the wheels 138 locate around them, no shock loads are imparted in either the guidance system or the surrounding framework of the platform 110 and turf tray 12.

Each wheel assembly is mounted onto two precision guide rails 140 more commonly used in extremely high precision applications such as CNC machines and metrology devices. This allows the wheel assembly to float from side to side but remain rigid in all other directions. A screw jack mechanism (not shown) with hand wheel drive facility is then used to set the position of the wheel assembly on the guide rails 140. It is impossible to back drive the screw jack so the whole assembly when left is rigid. If for any reason the gaps between the edges of the turf tray 12 and the pit wall 34 were to become uneven (misalignment) it would be very easy to re-establish the accurate position required simply by a few turns of the hand wheels.

In the unlikely event of a total loss of power to the system, the platform 110 can be raised or lowered using the previously mentioned manual pump on the hydraulic power pack and then it can be moved to any position that would normally be attainable by means of a winch mechanism (not shown) to replace the drive motors 114.

The winch mechanism is mounted at the rear wall of the pit 26 and can be connected to the back of the platform 110 to retrieve it from the second location 22 to the first location 18 (non-race mode) Also, the winch can be connected to the front of the platform 110 via a diverter pulley (not shown) mounted at a front wall of the pit 26 which mates with the leading edge 118 of the turf tray 12 in use, when it is to be pulled forward to the second location 22 (race mode).

The first embodiment of the present invention is a prototype turf tray moving system 10 which has been tested and shown to work effectively. The main test has involved running racehorses over the turf tray 12 when it is in its race mode and determining whether the horses perceive a difference. Racehorses are remarkably sensitive to the racetrack surface and it is surprisingly easy to determine differences in the racing surface due to a horse's reactions. Of particular importance has been the horses' reaction when a hoof has landed at the join between the turf tray 12 and the racetrack turf 68. Trials have shown that the horses do not appear to treat the artificial section of the racetrack 16 provided by the turf tray 12 any differently to the rest of the natural racetrack turf 68 even when the horse's hoof lands at the join. Further laboratory tests have shown that under simulated impact conditions, the coefficient of deformation of the turf at the edges of the turf tray and racetrack is substantially the same such that a racehorse should not be able to perceive a difference.

Figure 7:
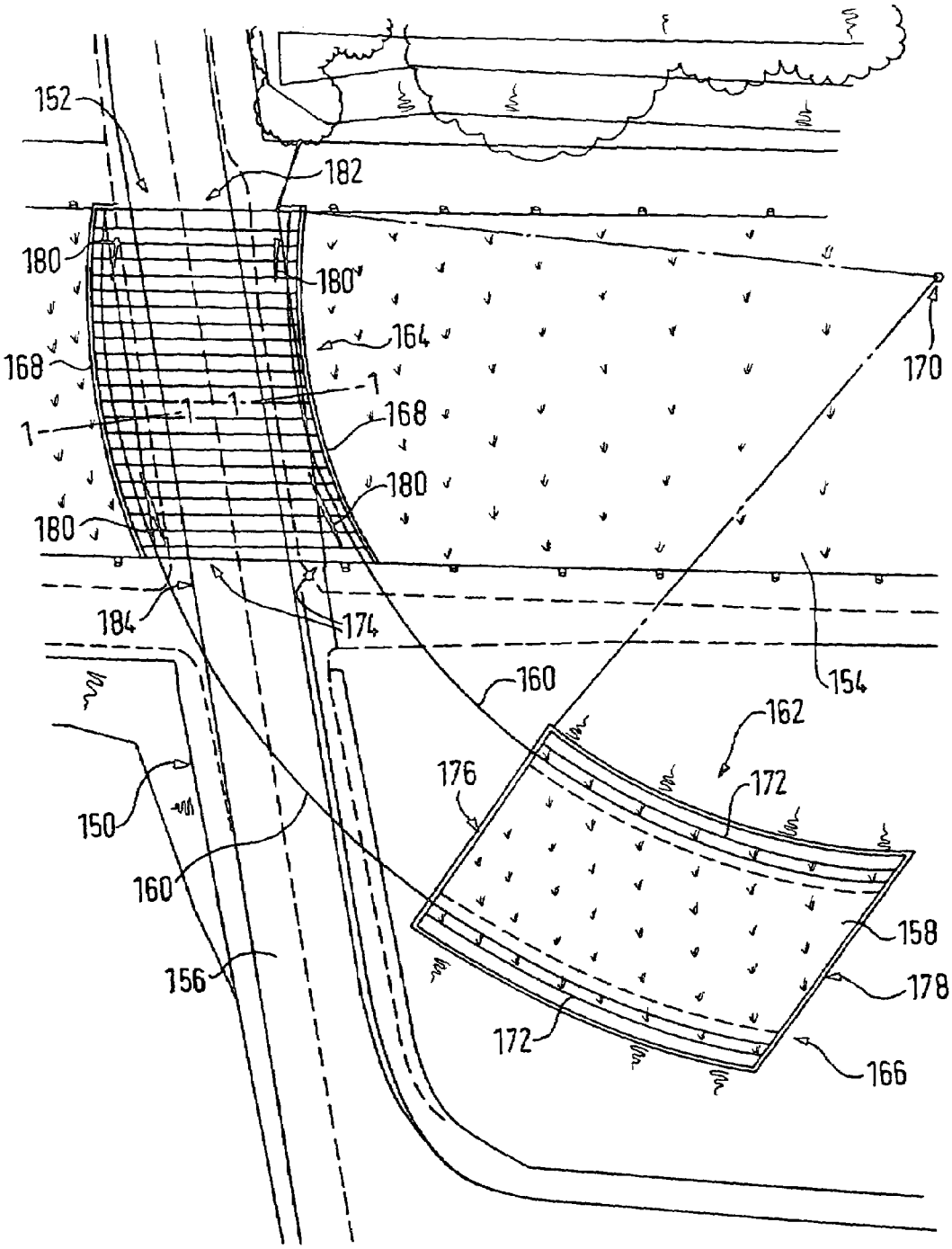
FIG. 7 is a schematic plan view of a turf tray moving system in an open mode according to a second embodiment of the present invention.

A second preferred embodiment of the present invention is now described with reference to FIGS. 7 and 8. This second embodiment is a turf tray moving system 150 that is provided as part of a reconfigurable crossing 152 between a turfed racetrack 154 and a road 156. More particularly, the second embodiment addresses the problems highlighted in the introduction regarding such existing crossings at racetracks. The construction of the turf tray 158 is governed by the overall requirement that the crossing 152 can be reconfigured quickly before a race meeting. Typically, the crossing 152 needs to be able to change from a non-race configuration (non-race mode) into a racing configuration (race mode) within a maximum of thirty minutes.

The turf tray moving system 150 is similar in many respects to that of the first embodiment and in order to avoid unnecessary repetition, only the differences will be described hereinafter. One of the most significant differences is that the turf tray 158 is moved in an arc on curved rails 160 between the first and second spaced apart locations 162, 164. The turf tray 158 is moved in such a manner to ensure that, in a non-race mode, it is stored out of line of the road 156 at a pallet docking area 166 as can clearly be seen in FIG. 7.

The edges 168 of the racetrack 154 at either side of the road crossing 152 are curved. Each racetrack edge 168 has a constant but different radius of curvature and both edges 168 are curved about the same setting out node point 170. The turf tray 158 has generally complementary curved edges 172 for mating with the curved edges 168 of the racetrack 154. However, although not shown in FIG. 7, the curvature of the turf tray edges 172 is slightly flared thereby creating a curved wedge shape for fitting into the gap 174 in the racetrack 154 with parallel curved edges 168. The term 'flared' means that the shortest orthogonal distance between the edges 172 of the tray 158 increases slightly from the leading edge 176 to the trailing edge 178 of the tray 158. This causes the turf tray 158 to wedge itself laterally into the gap 174 in the racetrack 154 if driven far enough. Details of the vertical mating between the curved turf tray walls and the racetrack edges 168 are described later with reference to FIG. 8.

Each of the curved rails 160 also has a constant but different radius of curvature with both rails 160 being curved about the same setting out node point 170. This effectively ensures that the curved rails 160 are always substantially equidistantly spaced apart which simplifies the construction of the wheeled platform of this railed transport system.

The second embodiment is provided with aligning wedge blocks 180, as in the first embodiment, for aligning the edges of the turf tray 158 with those of the racetrack 154 at the second location 164. However, it would be complicated to have these wedge blocks 180 provided centrally recessed in the middle of the road 156. Accordingly, two curved alignment wedge blocks 180 are provided one at either side of the road 156 at both the leading and trailing ends 182, 184 of the second location 164. Four complementary assemblies of buffer wheels (not shown) are provided at corresponding locations on the underside of the moving wheeled platform and turf tray 158 combination for engaging the curved alignment wedge blocks 180 in use to alter the lateral alignment of the tray 158 with the curved racetrack edges 168 if required.

When in the race mode, the tray 158 is positioned at the second location 164. In order to effect this, the tray 158 is raised at the first location 162 (the pallet docking area 166), moved to the second location 164 and then lowered to mate with edges 168 of the racetrack 154. The lowered tray 158 forms an effective wedge between the curved edges 168 of the racetrack 154 as in the previous embodiment. The mechanisms involved in the movement of the tray 158 are more powerful than in the previous embodiment because the turf tray 158 is considerably larger and consequently much heavier. The increased power is derived from higher power electric motors being provided to drive the wheels of the platform and by additional hydraulic pistons provided in the platform structure. Given the larger size of the turf tray moving system, the height to which the turf tray 158 is lifted is increased to 100 mm.

Figure 8:
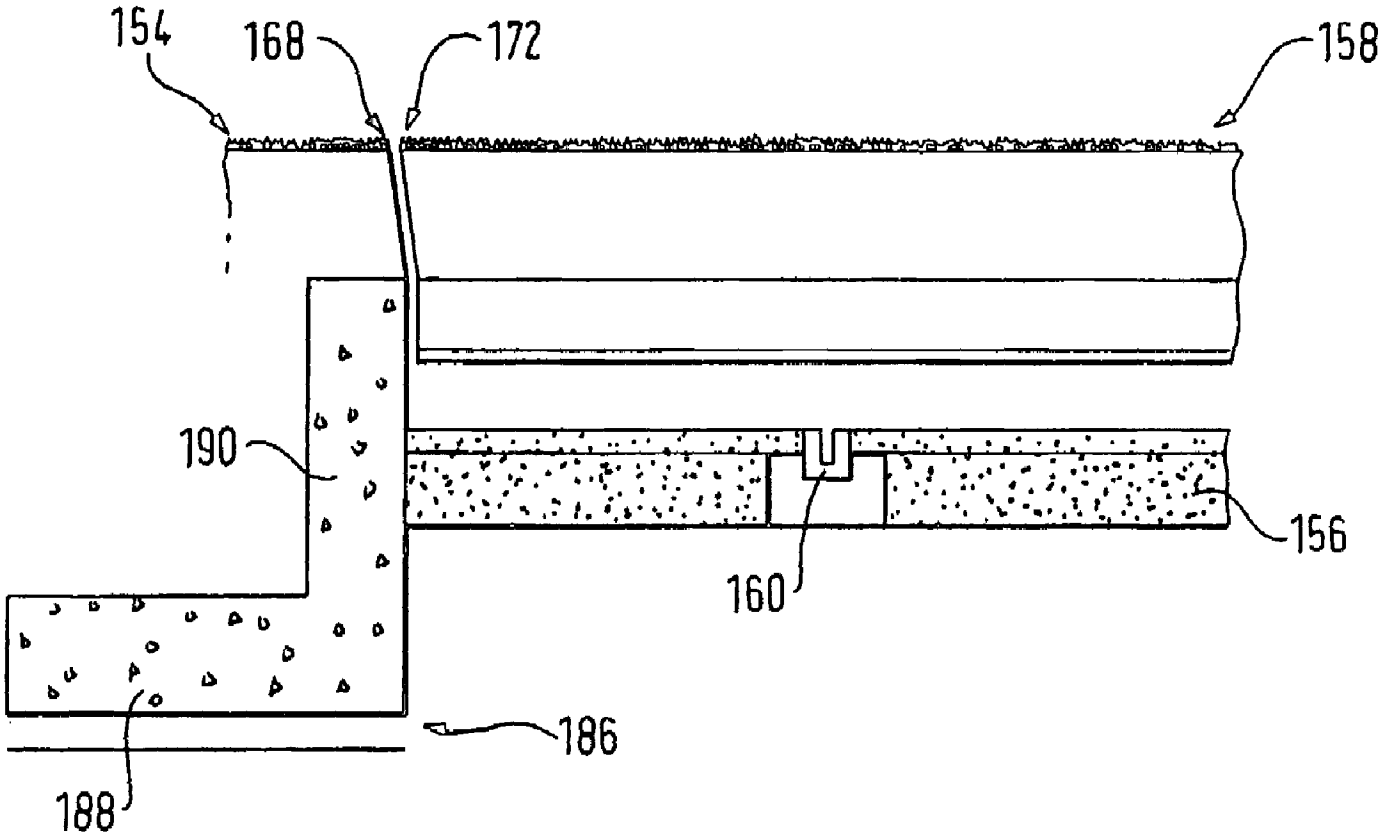
FIG. 8 is a schematic cross-sectional view of a section through the turf tray and the racetrack edge of FIG. 7 showing the complementary profiles of the turf tray and the racetrack edge when the turf tray moving system is in a closed position.

When the tray 158 is moved from the first location 162 to the second location 164, the engagement between the turf tray 158 and the edges of the racetrack 154 appears as shown in section in FIG. 8. (For ease of understanding, a slight gap between the edges 168, 172 of the racetrack 154 and the turf tray 158 has been artificially introduced into FIG. 8. However, it is to be appreciated that there is no such gap in practice when the turf tray 158 is in its lowered mating position.) Each of the racetrack's curved edges 168 has a concrete retaining structure 186 providing a base portion 188 and an upstanding portion 190. The upstanding portion 190 provides support for an edging material (not shown) which enables the racetrack edge 168 to be inclined at an predetermined angle to the vertical in a similar manner to that of the previous embodiment.

The turf tray 158 can be readily moved back to the first position 162 from the second position 164 once the race meeting has finished by simply reversing the above described procedure for engaging the turf tray 158 and the racetrack 154. The movement between the first and second positions typically takes ten minutes which is less than the maximum allowable period of thirty minutes.

Due to the increased weight of the turf tray, movement of the tray between the first and second positions in the event of a power failure is achieved by use of a vehicle such as a tractor or a jeep towing the turf tray. In order to facilitate this back up procedure, the turf tray is provided with a towing hook (not shown) for coupling to the vehicle.

The turf tray 158 has a complimentary engagement surface 172 formed in the same way as that described in the first embodiment. The wheeled platform, which is not shown in FIG. 8, supports the turf tray 158 of the second embodiment and is similar to that of the first embodiment except for its shape and size. The guide rails 160 for steering the wheels of the platform are cast into the road 156 such that when they are not being used for supporting the turf tray 158, they are unobtrusive to vehicles using the road 156 of the crossing 152.

Figure 9:
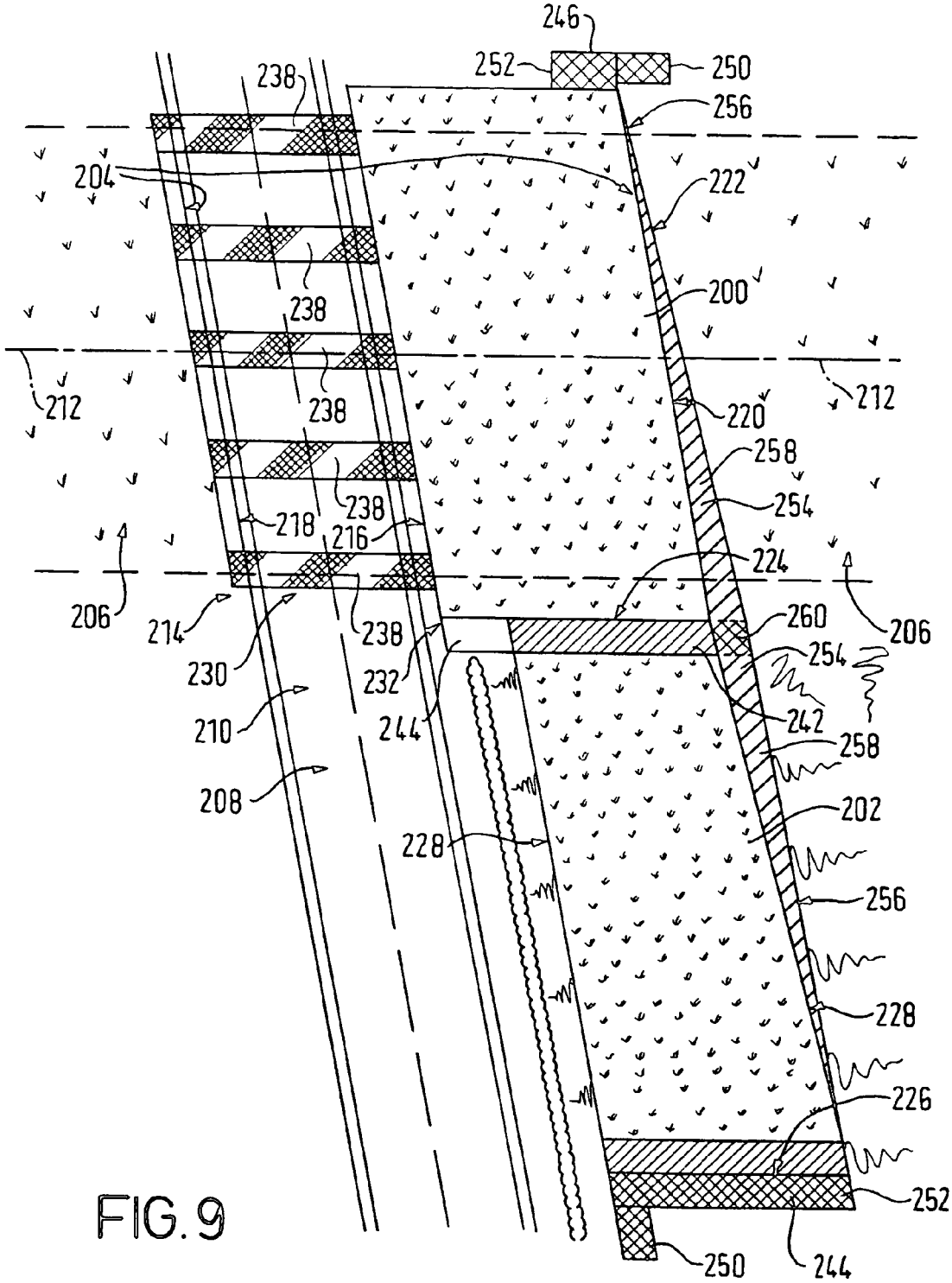
FIG. 9 is a schematic plan view of a turf tray moving system in an open mode according to a third embodiment of the present invention.
Figure 10:
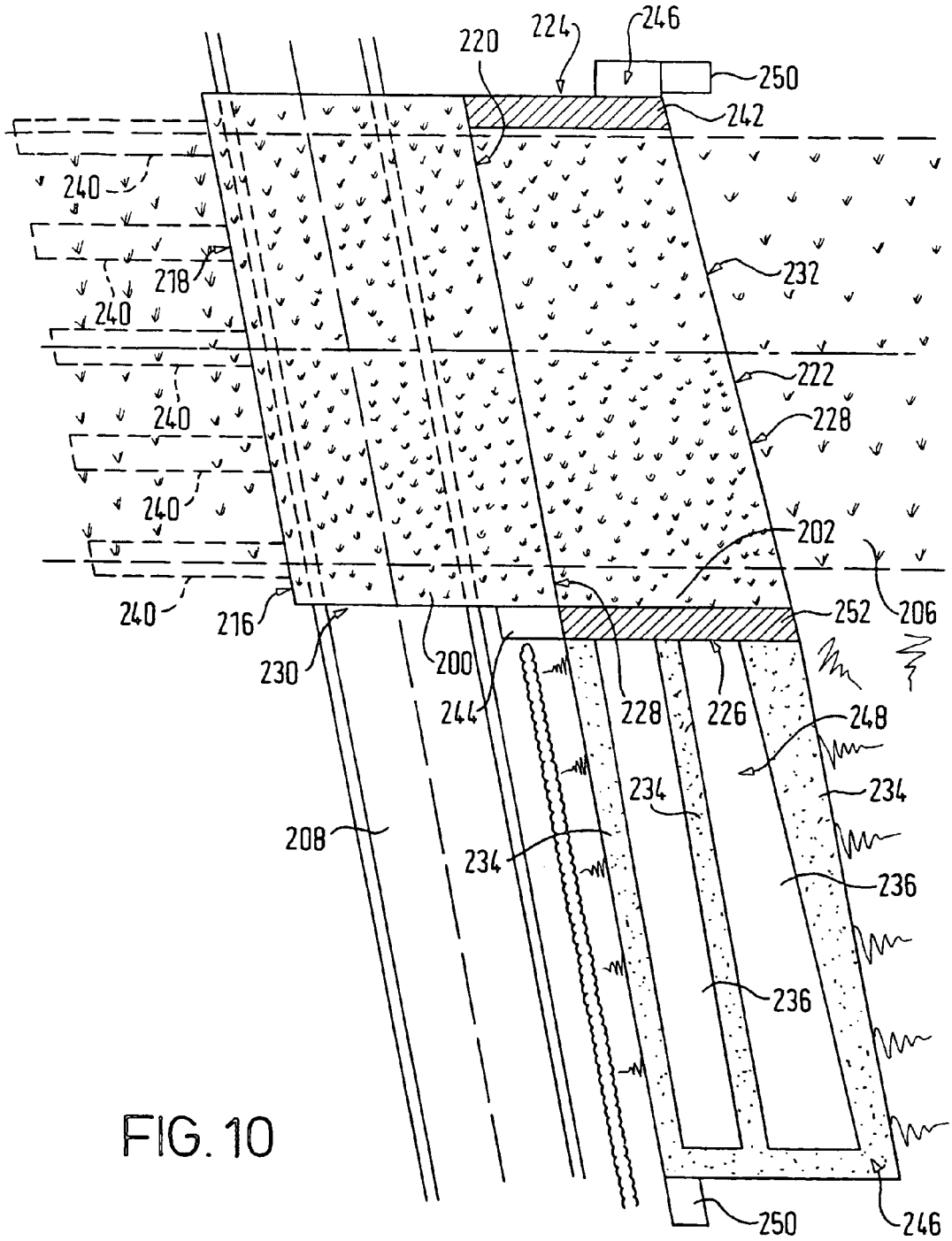
FIG. 10 is a schematic plan view of the turf tray moving system of FIG. 9 in a closed mode.

Referring now to FIGS. 9 and 10*a* third preferred embodiment of the present invention is described. There are various similarities between the third embodiment and the previously described first and second embodiments. For the sake of brevity, the following description will concentrate on the differences.

The most significant difference between the previous embodiment and the present one, is that two movable turf trays 200, 202 and their respective support platforms are provided for filling the gap 204 in the racetrack 206. Providing two movable turf trays 200, 202 is an alternative to the previous embodiment but still fulfils the aim of enabling the road 208 to be used normally when the turf tray moving system 210 is in a non-race mode. The movement of each turf tray 200, 202 in this embodiment is simpler than in the previous embodiment in that it is straight line movement only back and forth along a linear path.

The movement of the turf trays 200, 202, hereinafter referred to as pallet no. 1 and pallet no. 2, is now described below. In FIG. 9, pallet nos. 1 and 2 200, 202 are provided at one side of the road 208. Pallet no. 1 200 is positioned in the racetrack 206 and has a direction of movement which is along the racing line 212 of the racetrack 206. Pallet no. 2 202 is positioned alongside the racetrack 206 and has a direction of movement which is parallel to the centre of the road 208. Accordingly, when it is desired to close the crossing 214 to road vehicles and place it into a race mode, then pallet no. 1 200 is slid across the road 208 from its position shown in FIG. 9 to its position shown in FIG. 10. The gap left by movement of pallet no. 1 200 is then filled by movement of pallet no. 2 202 from its position shown in FIG. 9 to its position shown in FIG. 10.

A leading edge 216 of pallet no. 1 200 has a shape and profile suitable for engaging and mating with a first edge 218 of the racetrack 206 on the opposite side of the road 208. However, a trailing edge 220 of pallet no. 1 200 has a different profile to a second edge 222 of the racetrack 206 such that there is a gap between them.

Leading and trailing edges 224, 226 of pallet no. 2 202 do not need to mate with any part of the racetrack 206 and so are not specifically profiled for complementary engagement. However, the shapes and profiles of the elongate sides 228 of pallet no. 2 202 are critical in this embodiment. One elongate side 228 is shaped to match and engage with the trailing edge 220 of pallet no. 1 200 and the other elongate side 228 is shaped and profiled to engage with the second edge 222 of the racetrack 206 in use. In this regard, pallet no. 2 202 has a wedge shape for filling the wedge shaped area between the second edge 222 of the racetrack 206 and the trailing edge 220 of pallet no. 1 200 shown in FIG. 10. More specifically, the width of pallet no. 2 202 at its leading edge 224 is smaller that that at its trailing edge 226 such that when pallet no. 2 202 is moved into its race mode (FIG. 10) the shape of the turf tray 202 provides a lateral wedging action which forces pallet no. 1 200 against the first racetrack edge 218 and pallet no. 2 202 against the second racetrack edge 222. Thus pallet no. 2 202 is used to make an effective join between the edges 218, 222, 216, 228 of the racetrack 206 and the turf trays 200, 202.

In contrast to the previous two embodiments, the third embodiment does not employ overlapping angled turfed edges. The first and second edges 218, 222 of the racetrack 206, the leading and trailing edges 216, 220 of pallet no. 1 200 and the elongate side edges 228 of pallet no. 2 202 all comprise substantially vertical complimentary engagement surfaces. In this case, the flexible edge reinforcement material extends vertically from the ends of the turf tray upstanding side walls to provide support for the flexible edges 216, 220, 228 of each turf tray 200, 202. The flexible edge reinforcement material is positioned so as to extend slightly over the vertical line of each upstanding turf tray side wall. This enables a good contact to be made between the sides of each turf tray 200, 202 and the complimentary flexible side walls 220, 228 of the other turf tray 200, 202 or racetrack edge 218, 222, when the two are brought together.

In the previous embodiment, is little or no relative movement in establishing a join between the flexible edges of the racetrack 16, 154 and the turf tray 12, 158 when they have been in contact. This minimises wear on the flexible edges of the turf tray 12, 158 and the racetrack 16, 154 because there is very little rubbing of the surfaces when in contact. However, in the present embodiment, as the flexible edges of both the turf trays 200, 202 and the racetrack 206 are substantially vertical, when each turf tray 200, 202 is lowered or raised in its contact position, there is relative movement between the flexible edge surfaces. This leads to increased rubbing and wear between the flexible turf tray and racetrack edges 216, 218, 220, 222, 228.

The result of the wear is two fold. Firstly, a linear gap between the first edge 218 of the racetrack 206 and pallet no. 1 200 opens up. Secondly, the wedge shaped gap between the trailing edge 220 of pallet no. 1 200 and the second edge 222 of the racetrack 206 increases in size. These increases would normally cause dangerous gaps to appear between the two turf trays 200, 202 and/or between the turf trays 200, 202 and the edges 218, 222 of the racetrack 206. However, by extending the travel of both the turf trays 200, 202 to beyond that which would normally be required, this problem can be overcome. In particular, a widening gap between the second edge 222 of the racetrack 206 and the trailing edge 220 of pallet no. 1 200 is mitigated by pallet no. 2 202 having a wedge shape. The additional movement of pallet no. 2 202 ensures that the gap size is minimised to an acceptable level at the flexible edges to ensure a secure join between the moving turf trays 200, 202 and the fixed edges 218, 222 of the racetrack 206.

Another difference between the present embodiment and the previous embodiments is that there are no guide rails and wheeled platforms used to move the turf trays 200, 202. Rather the movement of the turf trays 200, 202 is by use of compressed air pads or compressed air bearings (not shown) such as those manufactured under the trademark Hovair™ to lift the combinations of turf tray 200, 202 and platform off of the ground. These air pads have been used in the past with turf tray moving systems and accordingly, their description is not elaborated on here because they are well known.

The air pads effectively lift the turf tray 200, 202 and platform slightly off ground. Once a turf tray 200, 202 has been lifted, it can either be manually pushed or pulled into its desired position or a simple movement mechanism (such as a winch described in the first embodiment) can be used to impart unidirectional lateral movement to the turf tray. During its movement, it is necessary to ensure that the movement remains substantially linear. Accordingly, the guidance system of the turf tray moving system is not only provided at the respective second positions 230, 232 (racetrack engagement) of the turf trays 200, 202 but also along the length of travel of each turf tray from the first positions 230, 232. The guidance system includes a plurality of lateral alignment guide blocks (not shown) which cooperate with guide units on each platform to prevent each turf tray from being misaligned during its respective movement.

The use of air pads simplifies the design of the turf tray support platforms in that no hydraulic lifting systems, pivot arms and motorised flanged wheel drive mechanisms are required. However, all floor surfaces over which the trays 200, 202 are to move and which are in concrete, have to be suitably prepared for air pads. In this embodiment, a power float finish is applied to the tops of the reinforced concrete slabs which make up the runways 234 for the air pads. The runway surfaces have to be as smooth as possible and typically the undulations should be within the range of +2% in 3000 mm, for example, in the critical air bearing travel regions. Other regions 236 between the runways 234 are required to be slightly sloping to enable water drainage.

Turning now to some of the other specific features of this embodiment, five smooth concrete runways 234 are provided across the road 208 for the air pads of pallet no. 1 200. Each of these runways 234 is provided below the level of the road 208 to prevent damage thereto by vehicle traffic. Each runway 234 is protected by a finger pallet (not shown) and a metal cover 238 when the turf tray moving system is in a non-race mode. The finger pallets provide support for the metal covers 238 when the turf tray moving system in a non-race mode. The finger pallets and metal covers 238 are attached to the platform of pallet no. 1 200 at its leading edge 216 and each finger pallet also has three air pads provided on its underside for supporting the weight of the finger pallet. When pallet no. 1 200 is slid towards the first racetrack edge 218, the finger pallets and covers 238 are pushed into five corresponding receiving chambers 'garages' 240 provided underneath the racetrack 206.

Pallet no. 2 202 is provided with a cover 242 to maintain road access along the side of the racetrack 206. Access to the cover 242 is via a ramp 244 and this allows motorised vehicles such as lawn mowers to continue to have access to the racecourse 206 and also to the upper surfaces of the turf trays 200, 202. Two trenches 246 are provided at either end of the excavated turf tray retaining pit 248. These trenches 246 allow for positioning of 'tuggers', namely apparatus for pulling the turf trays 200, 202 into position should the air pads fail. Each of the trenches 246 is accessible via a respective ramp 250. Both of the trenches 246 and ramps 250 are protected by respective temporary covers 252. However, the pallet no. 2 trench cover 252 is actually fixed to the platform of pallet no. 2 202 itself and when pallet no. 2 202 moves, the trench cover 252 also moves to expose the trench 246.

FIG. 9 shows the two wedge-shaped gaps 254 at the sides of the turf trays 200, 202 which are parts of the excavated pit 256 within which the turf trays 200, 202 move. Both these gaps 254 are temporarily covered with respective easily removable lightweight covers 258 when the system is in the non-race mode. In addition, to facilitate motorised vehicle access across the wedge shaped gaps 254, a load bearing support cover 260 is provided in line with the access cover 242.

The power supply and compressor unit required for the operation of the turf tray moving system is housed remotely from the turf trays 200, 202 and excavated pit 256. Compressed air lines and power lines (not shown) deliver the compressed air and electric power from the remote location to the turf trays 200, 202.

Although the present embodiment has been described as having vertical edge profiles on all mating surfaces, it is to be appreciated that the angled edge profiles described in the first and second embodiments could also be used to effect the close mating of turf tray and racetrack edges 216, 218, 220, 222, 228. More specifically, the first and second edges 218, 220 of the racetrack 206 would have edges angled away from the excavated pit 256 as in the first and second embodiments, the trailing edge 220 of pallet no. 1 200 would have an edge angled towards its leading edge 216 and the elongate side edge 228 of pallet no. 2 202 would have an edge angled away from its other side edge 228. In this way, pallet no. 2 202 would form an overlap over the trailing edge 220 of pallet no. 1 200.

Figure 11A:
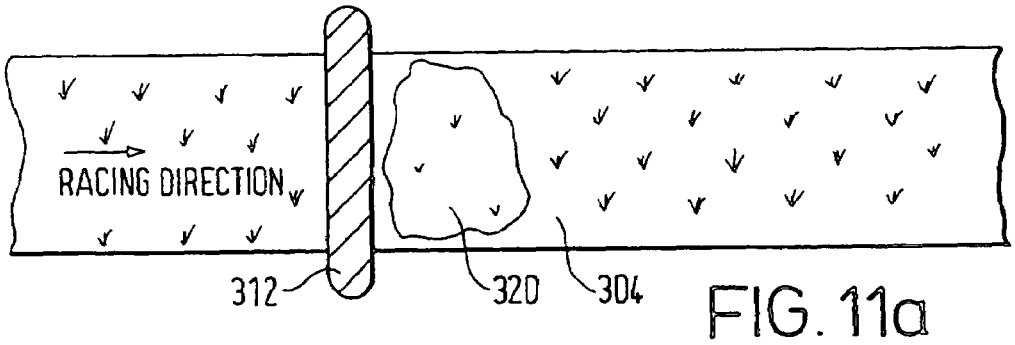
FIG. 11*a* is schematic plan views of a racetrack showing a racetrack fence and an area of wear of the racetrack turf associated with the fence.
Figure 11B:
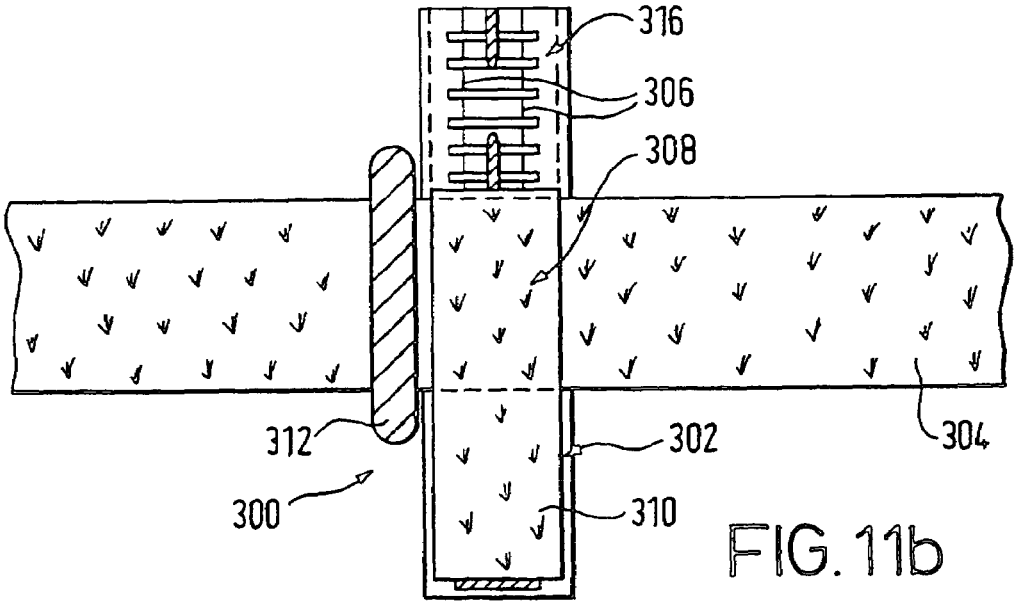
FIGS. 11*b* and 11*c* are schematic plan views of the turf tray moving system according to a fourth embodiment of the present invention in open and closed modes respectively.
Figure 11C:
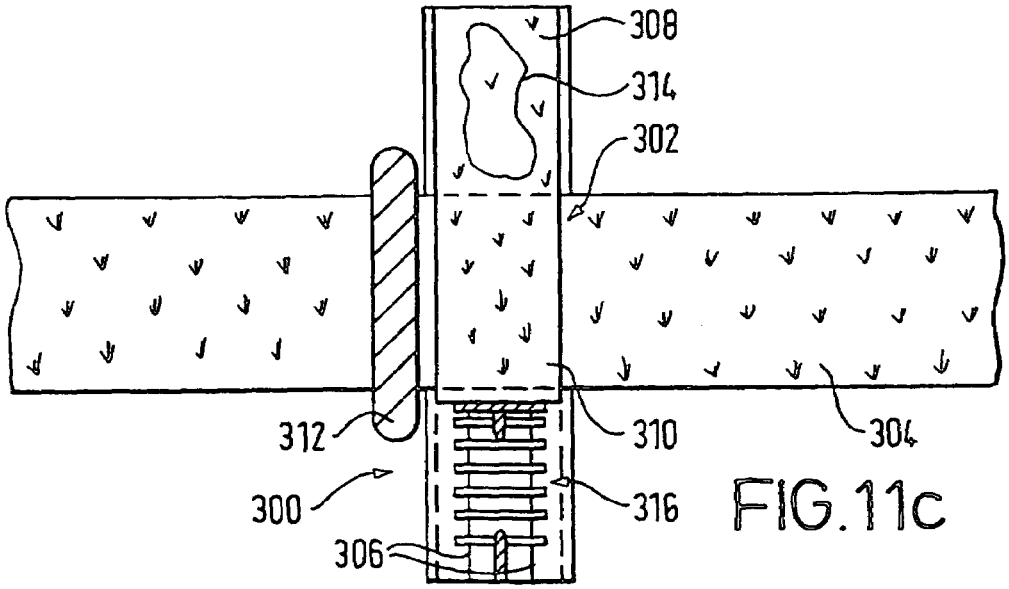

Referring now to FIGS. 11*b* and 11*c*, a fourth embodiment of the present invention is now described. The fourth embodiment employs a single turf tray system 300 with linear movement as in the first embodiment. Accordingly, to avoid unnecessary repetition, the following description is directed to the differences between the first and fourth embodiments.

The turf tray 302 is significantly longer than in the first embodiment, the length is at least twice the width of the racetrack 304. Similarly, the guide rails 304 extend to at least three times the width of the racetrack 304. Otherwise the movement and structure of the turf tray 302 and wheeled platform are substantially as described before.

The turf tray 302 is designed to be movable between two locations, both of which are suitable for racing on the track. In one location, a first half 308 of the turf tray 302 forms part of the racetrack 304 with a second half 310 not in line with the racetrack 304 (FIG. 11*b*). At the other location, the second half 310 is in line with the racetrack 304 and the first half 308 is shifted out of line (FIG. 11*c*).

In use, when horses jump over a fence 312 they land on one half 308 of the turf tray 302. The turfed surface of this half 308 of the tray 302 inevitably wears down with the high level of impact. Once it has reached a predetermined level, the turf tray 302 is moved into its alternative position such that the worn surface region 314 of the turf tray 302 is moved out of the line of racing and the other half 310 of the turf tray 302 which is not worn down is moved into the racing line for exposure to the horses' hoofs.

The open parts of the excavated pit 316 have a cover (not shown) provided over them. This prevents unauthorised access to the tray moving system 300 and also minimises the risk of startling the horses as they jump over the fence 312.

Figure 12A:
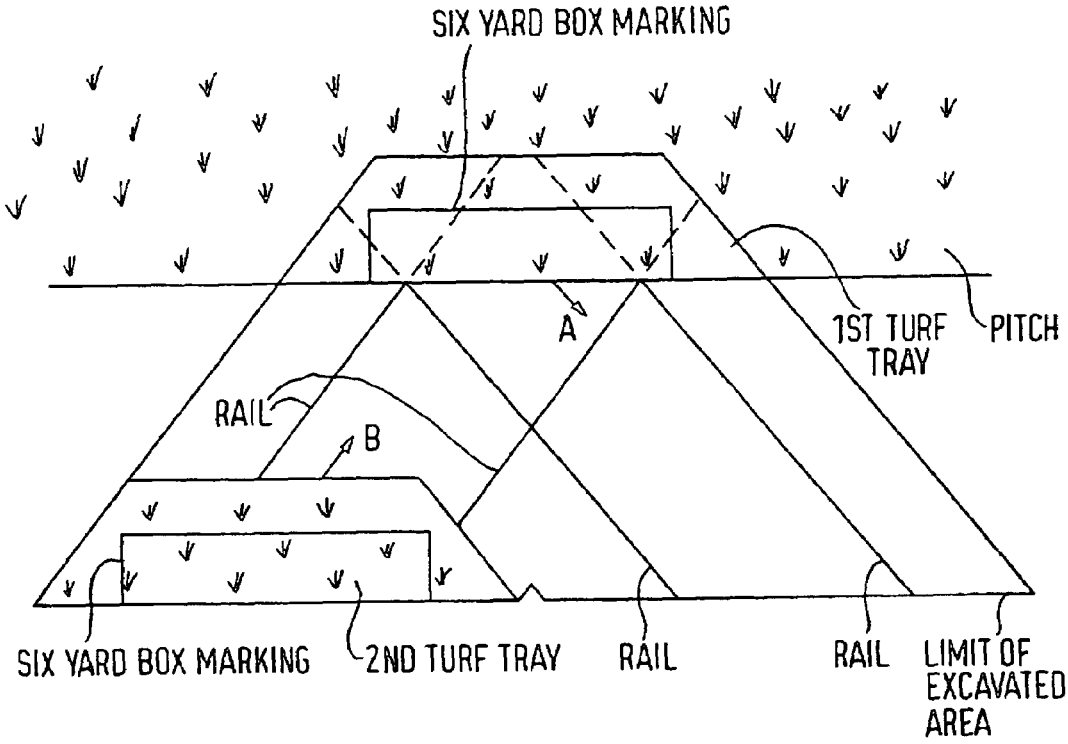
FIG. 12*a* is a schematic plan views of a turf tray moving system according to a fifth embodiment of the present invention which is used for worn turf replacement on a sports pitch.

A similar worn turf replacement system according to a fifth embodiment of the present invention can be used in the replacement of worn portions of turf playing surfaces for many sporting activities including rugby, football, cricket, tennis and other sports. For example, in football, the region around the so-called 'six-yard box' is often worn down before any other part of the pitch. This region of excessive wear can be replaced by use of a two-tray system which moves on two sets of rails as shown schematically in FIG. 12*a*. The turf tray and wheeled platform is substantially as described in the above first embodiment. One tray moves on one set of rails, in the direction indicated by arrow A, and the other tray on the other set of rails, in the direction indicated by arrow B. Each of the trays is large enough to cover the six-yard box and is trapezoidal in shape. Once one tray has worn down, it is moved away from the pitch and the other non-worn turf tray is moved into connection with the pitch.

It is also important in this worn turf replacement system to provide robust cover sections for the exposed areas such that during a game there is no risk of the players falling into the excavated pit containing the rails. The quality of the surface of these cover sections is not important, as they do not form part of the activity surface.

Figure 12B:
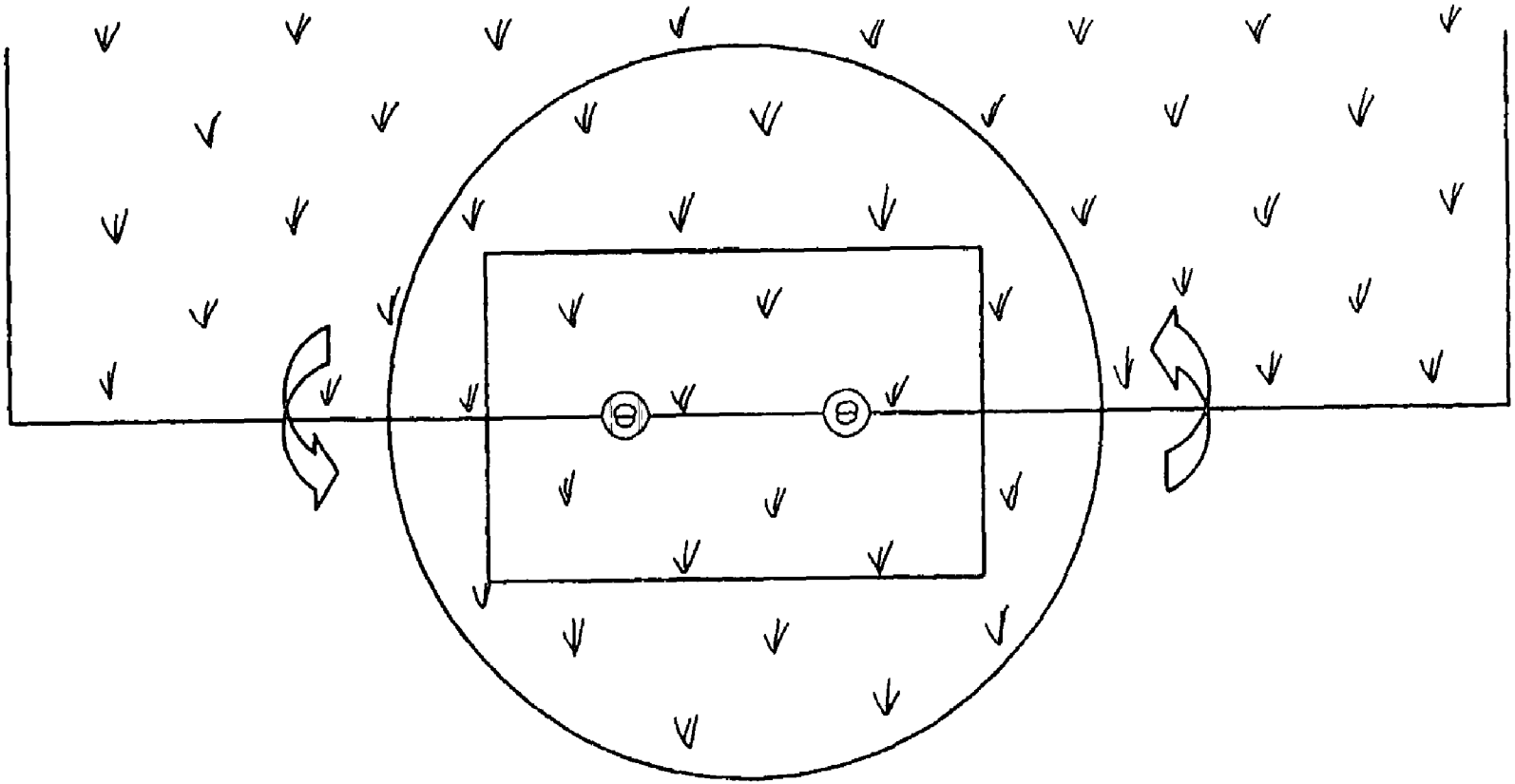
FIG. 12*b* is a schematic plan views of a turf tray moving system according to a sixth embodiment of the present invention which is an alternative to the fifth embodiment that is used for worn turf replacement on a sports pitch.

An alternative worn turf replacement system to the fifth embodiment is shown in FIG. 12*b* as the sixth embodiment of the present invention. Here there is a single circular turf tray that is rotatable about a pivot point. The pivot point is provided at a location that is on the goal line and is equidistant from the positions of the goal posts. As the circular shape tray is large enough to cover the six-yard box, a 180° rotation of the turf tray can replace a whole worn area of the goal mouth. In this system, there is no need to use rails. Rather, as the rotational motion of the tray is constrained by the pivot point, any wheeled system may be used which has a tray lifting capability provided. The 180° rotation is determined by use of fixed markers on the body of the tray and marker sensors positioned in the tray pit. The stages of movement, lifting the tray moving it into the new position and then lowering the tray are similar to the fifth embodiment and do not require further explanation herein. Advantageously, there is no need for the use of covers in this system.

A moveable tray system for a racetrack crossing according to a seventh embodiment of the present invention is now described with reference to FIGS. 13*a*, 13*b*, 14*a*, 14*b*, 15*a* and 15*b*. This seventh embodiment is a turf tray moving system 400 that is provided as part of a rapidly reconfigurable crossing between a turfed racetrack 402 and a road 404 in a similar manner to the second embodiment. More particularly, the second embodiment addresses the problems highlighted in the introduction regarding such existing crossings at racetracks 402. The turf tray moving system 400 is similar in many respects to that of the first and second embodiments and in order to avoid unnecessary repetition, only the differences will be described hereinafter.

One significant difference is that the system 400 is designed to useable in situations where the road 404 runs adjacent the racetrack 402 and so at the crossing there is a very short distance between the edge of the racetrack 402 and the start of the approach into the crossing. In such a situation, there is not enough space to lower the road 404 at a gradient suitable for vehicles to reach the level of the base of an excavated tray-moving pit 406. Accordingly, in the present embodiment, a collapsible ramp 408 is provided within the excavated pit 406.

Figures 13A, 13B:
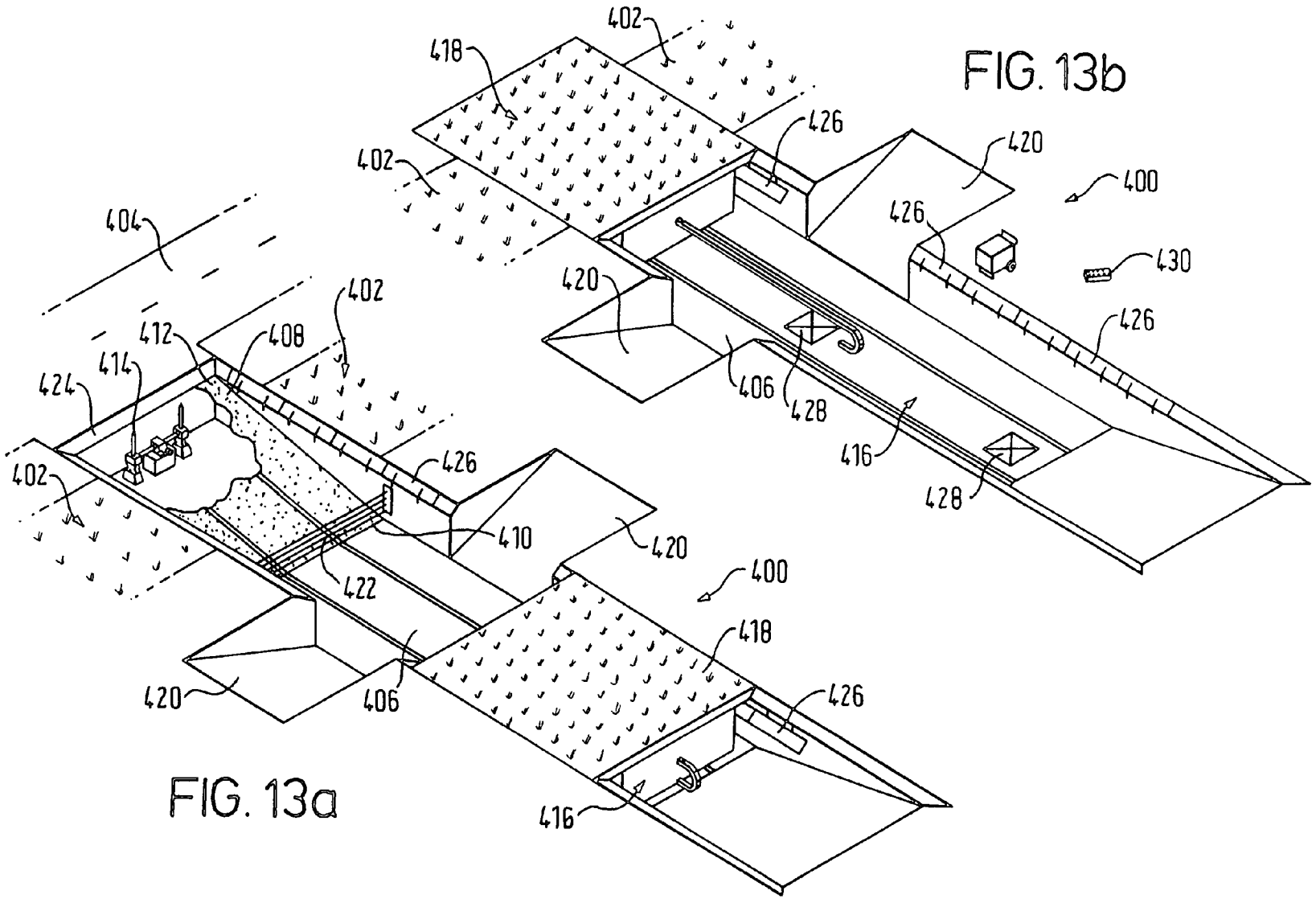
FIGS. 13*a* and 13*b* are perspective views of a moveable tray system for a racetrack crossing according to a seventh embodiment of the present invention in open and closed configurations.
Figure 14A:
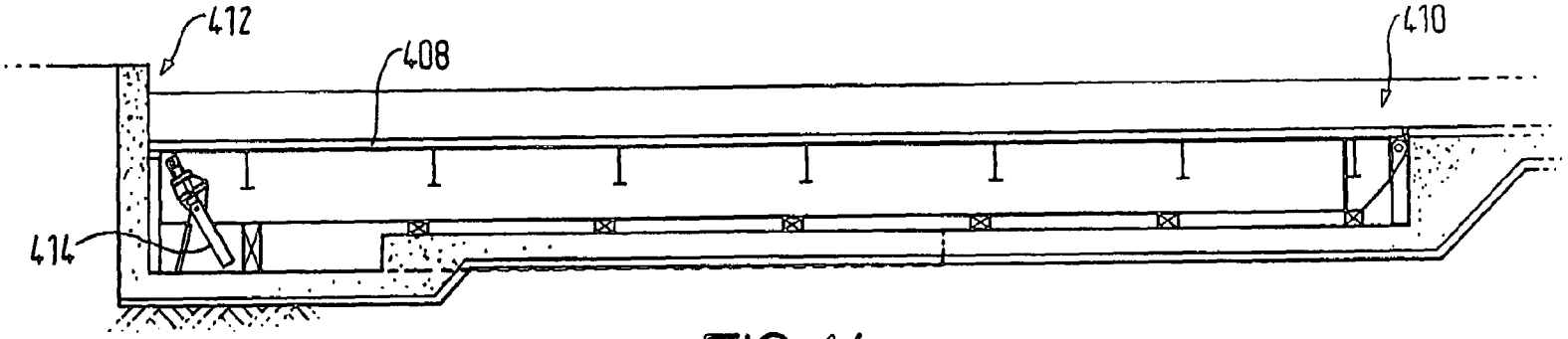
FIGS. 14*a* and 14*b* are cross-sectional views of a ramp area of the racetrack crossing of FIGS. 13*a* and 13*b* showing a ramp of the crossing in lowered and raised positions respectively.
Figure 14B:
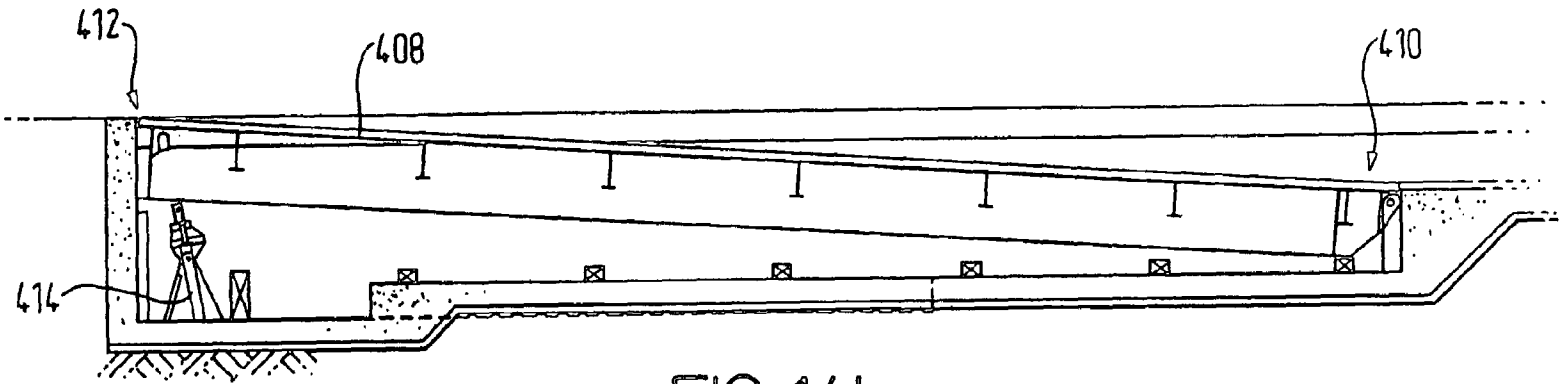

The ramp 408 as seen in FIGS. 13*a*, 14*a* and 14*b* is pivoted at a tray end 410 and is vertically movable at a road end 412 by means of a screw jack system 414. The screw jack system 414 has two screw jacks that are used to raise and lower the road end of the ramp 408. Each screw jack is connected to a geared motor via a drive shaft such that they always raise and lower the ramp 408 in unison. The jacks are self-sustaining so they do not require any additional braking system. The motor has an additional input shaft to allow the ramp 408 to be manually raised in the event of a power failure.

The upper road surface of the ramp 408 is coated with an epoxy resin into which surfacing grit is set to give the ramp 408*a* very good non-slip surface. The excavated pit 406 into which the ramp 408 leads is cross-shaped to provide a parking bay 416 for a turf tray 418 and permanent (concrete) vehicle access ramps 420 perpendicular to the crossing. FIG. 13*a* shows the turf tray 418 parked in the parking bay 416 and the ramp 408 up. FIG. 13*b* shows the turf tray 418 engaged with the racetrack 402 and the ramp 408 down.

At the tray end 410 of the ramp 408, a light curtain 422 is provided. The light curtain 422 acts as a safety device that can detect the presence of the leading edge of the turf tray 418 as it approaches the crossing to close the gap in the racetrack 402. An interruption of the light curtain 422 is used to check the condition of the ramp 408 and if the ramp 408 is raised, movement of the turf tray 418 is stopped. If, however, the ramp 408 is in a lowered condition, the turf tray 418 is allowed to move into the ramp area of the excavated pit 406 and close the gap in the racetrack 402.

As can be seen in FIG. 13*a*, the ramp area of the excavated pit 406 has an inclined end abutment edge 424 for mating with the complimentary inclined leading edge of the turf tray 418. The provision of the inclined edge 424 is important for a lead into the ramp 408.

Movement of the turf tray 418 is semi-automated. At both ends of the travel, an auto-parking sequence is implemented to remove the possibility of any human error. Although not shown, the turf tray 418 has a proximity sensor mounted to its undercarriage that can sense markers (not shown) provided at two meters from the ends of the tray travel. The automated parking sequence moves the tray 418 slowly into its final position and then lowers it into engagement with the fixed edges of the racetrack 402 or the parking bay 416.

Figure 15B:
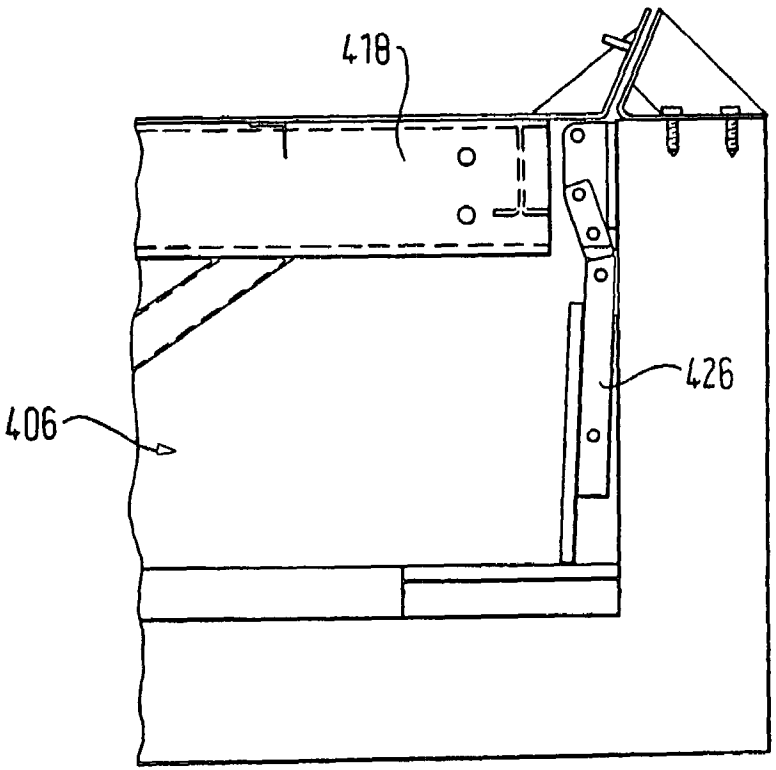
FIGS. 15*a* and 15*b* are cross-sectional views of the pit walls of the racetrack crossing of FIGS. 13*a* and 13*b* showing respectively a folding guard in a raised position the folding guard in a lowered position with the turf tray in place.
Figure 15A:
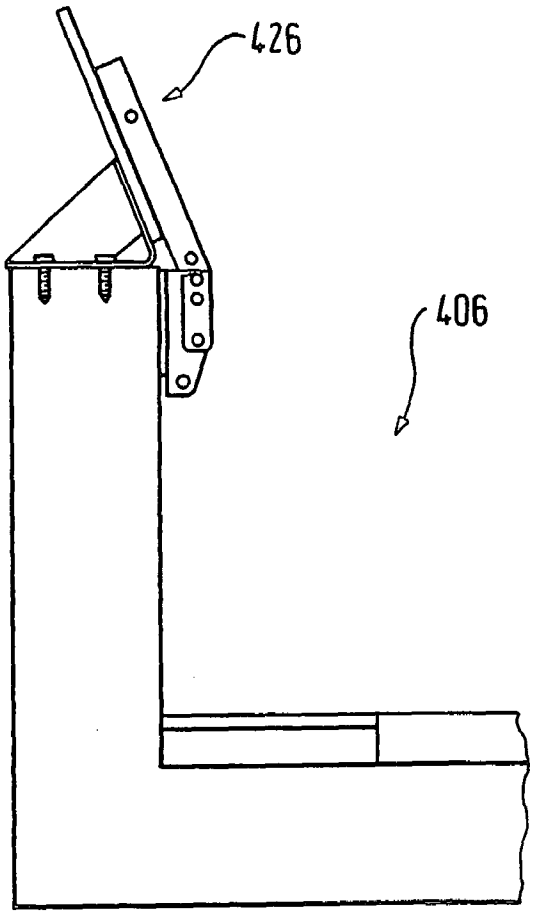

At both the edges of the racetrack 402 and the parking bay 416, folding guards 426 are provided. The folding guards 426 protect the edge of the turf when it would otherwise be exposed. Each guard comprises a wooden turf engaging section and a pair of robust hinges. FIG. 15*a* shows a folding guard 426 in a raised position and FIG. 15*b* shows it in a lowered position with the turf tray 418 in place. Each guard 426 can be secured in the raised or lowered positions with a respective locking pin.

Other features of the turf tray moving system 400 include manhole covers 428 and associated wells provided in the excavated pit 406. These covers 428 conceal winching points in the wells in which mechanical winding gear is provided for use if the electrical motors of the tray drive system fail. In this regard, the tray 418 comprises some motor driven wheels and some non-driven wheels. The driven wheels can be manually raised to be out of engagement with the rails such that the tray can become free moving in the event of a motor failure. The free moving tray could be winched or dragged into position by tractors in this situation.

The system 400 is controlled by means of a radio-controlled remote 430. The remote 430 allows an operator to control movement of the turf tray 418 without the need to walk up and down with the tray 418 during its movement.

In the above embodiments of the present invention, turfed surfaces have been used. However, the present invention is not limited to turfed surfaces and could utilise any particular surface. In particular, the present invention can advantageously provide continuous surfaces where the users' interaction with the surface requires the response of the surface to be consistent.

Having described particular preferred embodiments of the present invention, it is to be appreciated that the embodiments in question are exemplary only and that variations and modifications such as will occur to those possessed of the appropriate knowledge and skills may be made without departure from the spirit and scope of the invention as set forth in the appended claims.

It is to be appreciated that the present invention can be extended to a replaceable sports surface comprising a plurality of movable turf trays. The replaceable sports surface could be a turfed football pitch, tennis court, cricket pitch, racetrack, or any other sports activity surface. The trays could each be provided on rails with a movement mechanism similar to that described above. The key to any such system is how the edges of the turf trays interact and are joined together. In this case, the preferred method is to use angled overlapping edges which when connected together form a reliable pressure join that produces the same characteristics as a conventional continuous surface.

What is claimed is:

1. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the guiding means is arranged to exert a substantially horizontal wedging action at edges of the activity surface at the gap and the edges of the tray.

2. An apparatus according to claim 1, wherein the apparatus is arranged to reopen the gap by disengaging the movable tray from the gap and the guiding means is arranged to guide the tray out of the gap away from the activity surface.

3. An apparatus according to claim 1, wherein the apparatus is arranged to close or reopen the gap relatively quickly such that the condition of the activity surface can be changed relatively quickly.

4. An apparatus according to claim 1, wherein both the activity surface and the upper surface of the movable tray comprise turfed surfaces.

5. An apparatus according to claim 4, wherein the turf of both the activity surface and the movable tray is provided on a layer of topsoil having a minimum depth of 150 mm, such that when tray is wedged in the gap, a continuous layer of topsoil is formed having a minimum depth of 150 mm.

6. An apparatus according to claim 1, wherein the upper surface of the movable tray is arranged to have substantially the same coefficient of deformation as that of the activity surface such that when the tray is wedged in the gap, the resultant continuous activity surface has a substantially uniform coefficient of deformation.

7. An apparatus according to claim 1, wherein the movable tray comprises a plurality of movable trays for closing the gap with at least one of the trays being arranged to exert a wedging action in the gap.

8. An apparatus according to claim 1, wherein the activity surface comprises a pathway.

9. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the guiding means is arranged to exert a substantially vertical wedging action at edges of the activity surface at the gap and the edges of the tray.

10. An apparatus according to claim 9, wherein the apparatus is arranged to reopen the gap by disengaging the movable tray from the gap and the guiding means is arranged to guide the tray out of the gap away from the activity surface.

11. An apparatus according to claim 9, wherein the apparatus is arranged to close or reopen the gap relatively quickly such that the condition of the activity surface can be changed relatively quickly.

12. An apparatus according to claim 9, wherein both the activity surface and the upper surface of the movable tray comprise turfed surfaces.

13. An apparatus according to claim 12, wherein the turf of both the activity surface and the movable tray is provided on a layer of topsoil having a minimum depth of 150 mm, such that when tray is wedged in the gap, a continuous layer of topsoil is formed having a minimum depth of 150 mm.

14. An apparatus according to claim 9, wherein the upper surface of the movable tray is arranged to have substantially the same coefficient of deformation as that of the activity surface such that when the tray is wedged in the gap, the resultant continuous activity surface has a substantially uniform coefficient of deformation.

15. An apparatus according to claim 9, wherein the movable tray comprises a plurality of movable trays for closing the gap with at least one of the trays being arranged to exert a wedging action in the gap.

16. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the movable tray comprises a base and upstanding side walls, the side walls comprising substantially vertical portions and upper portions provided at an angle to the vertical.

17. An apparatus according to claim 16, wherein the upper portions are arranged at an acute angle to the vertical.

18. An apparatus according to claim 17, wherein the upper portions are arranged at an angle of around 22 degrees to the vertical.

19. An apparatus according to claim 16, wherein the tray comprises a liquid drainage grid provided at the base of the tray.

20. An apparatus according to claim 16, wherein the tray comprises a coarse drainage material.

21. An apparatus according to claim 16, wherein the tray comprises a top soil filling extending beyond the height of the upper portions of the side walls.

22. An apparatus according to claim 16, wherein the tray further comprises an edging material and a soil filling, the edging material and soil filling being arranged to provide a tray edge which extends beyond the upper portion of the side walls at the same angle to the vertical as the upper portion of the side wall.

23. An apparatus according to claim 22, wherein the edging material extends along the upper portion of the side wall and continues along the same direction as the upper portion for a predetermined distance before being folded back into the soil to anchor the edging material.

24. An apparatus according to claim 22, wherein the edging material comprises a porous geotextile or porous plastics sheeting.

25. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the edge profiles of the activity surface at the gap and of the movable tray comprise complimentary wedge shapes as viewed in a vertical plane.

26. An apparatus for closing a fixed gap in an activity surface, the apparatus comprising a movable tray having an upper surface with the same characteristics as the activity surface and means for guiding the tray into the so as to we the tray releasably in the gap and thereby to provide a substantially continuous activity surface, wherein the edge profiles of the activity surface at the gap and of the movable tray comprise complementary wedge shapes as viewed in a horizontal plane.

27. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the edge profiles of the activity surface at the gap and of the movable tray comprise complementary carved edges as viewed in a horizontal plane.

28. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface and further comprising a support platform for the movable tray, wherein the support platform houses a movement system for moving the support platform and tray into the gap.

29. An apparatus according to claim 28, wherein the support platform comprises a plurality of diagonal support members arranged in groups, each group being arranged to focus the weight of a region of the tray to a single location.

30. An apparatus according to claim 28, wherein the movement system comprises a set of wheels and the apparatus further comprises a set of guide rails for guiding the tray into the gap.

31. An apparatus according to claim 30, wherein the guide rails are curved.

32. An apparatus according to claim 30, wherein the movement system comprises means for raising and lowering the platform and tray.

33. An apparatus according to claim 32, wherein the raising and lowering means comprise a set of hydraulic actuators acting on respective over-centre pivot arms, each over-centre pivot arm being connected to a wheel of the set of wheels.

34. An apparatus according to claim 32, wherein the raising and lowering means has a independent override means including a back-up pump for enabling the raising and lowering to be effected independently.

35. An apparatus according to claim 32, wherein the support platform comprises a plurality of support legs for supporting the weight of the tray and platform when the platform is in a lowered condition and from which weight can be transferred to the wheels via the over-centre pivot arms on actuation of the hydraulic actuators to place the platform into a raised condition.

36. An apparatus according to claim 35, wherein each support leg is provided with a 'C' shaped pad for securely engaging the guide rail.

37. An apparatus according to claim 30, wherein the width of each of wheel is oversized with respect to the width of the each rail so as to allow relative lateral movement of the platform and tray.

38. An apparatus according to claim 28, wherein the movement system comprises electric drive motors, the motors being pulse controlled such that the rate of movement and positioning of the platform can be varied and controlled accurately.

39. An apparatus according to claim 38, wherein the movement system further comprises a digital controller for controlling the movement of the platform and tray via the electric drive motors.

40. An apparatus according to claim 39, further comprising proximity markers provided at predetermined distances from ends of travel of the movable platform and tray and the movement system further comprising a proximity marker sensor for detecting the presence of the markers in order to slow down or speed up the movement.

41. An apparatus according to claim 39, wherein the raising and lowering means comprises limit switch means for disabling lateral movement of the tray until the tray has been fully raised.

42. An apparatus according to claim 28, wherein the movement system comprises hover means disposed at an underside of the platform for creating a fluid cushion and raising the platform off the ground such that it can be moved laterally.

43. An apparatus according to claim 42, the movement system further comprises at least one runway for providing a smooth flat surface for movement of the fluid cushion created by the hover means.

44. An apparatus for closing a fixed gap in an activity surface, the apparatus comprising a movable tray having an upper surface with the same characteristics as the activity surface, means for guiding the tray into the gap so as to wedge the tray releasably in the gap and thereby to provide a substantially continuous activity surface and an alignment system for aligning the edges of the tray with the edges of the activity surface at the gap at one end of the movable tray's travel.

45. An apparatus according to claim 44, wherein the alignment system comprises alignment wedges provided at fixed locations with respect to the edges of the activity surface at the gap and guide means interactive with the alignment wedges for locating the platform and tray in a predetermined alignment with the edges of the activity surface at the gap.

46. An apparatus according to claim 45, wherein the guide means comprise at least one wheeled housing which in use acts to move the platform and tray laterally until the platform is aligned correctly.

47. An apparatus according to claim 46, wherein the guide means comprises a plurality of wheeled housings, the wheeled housings being positioned at opposed ends of the platform for aligning each end in use.

48. An apparatus for closing a fixed gap in an activity surface, the apparatus comprising a movable tray having an upper surface with the same characteristics as the activity surface, means for guiding the tray into the gap so as to wedge the tray releasably in the gap and thereby to provide a substantially continuous activity surface and winch means connectable to the tray or platform for effecting movement of the same.

49. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the guiding means is arranged to move the tray such that edges of the tray move into engagement with edges of the activity surface at the gap at an angle to the plane in which at least the upper portions of the edges of the activity surface at the gap are provided.

50. An apparatus for closing a fixed gap in an activity surface, the apparatus comprising a movable tray having an upper surface with the same characteristics as the activity surface and means for guiding the tray into the gap so as to wedge the tray releasably in the gap and thereby to provide a substantially continuous activity surface, wherein the edges of the activity surface at the gap are provided with a reinforcing wall structure for maintaining the uniformity of the edges of the activity surface and wherein each edge of the activity surface at the gap further comprises an edging material and a soil filling, the edging material and soil filling being arranged to provide an activity surface edge which extends beyond the upper portion of the reinforcing wall structure side walls and wherein the edging material extends along the upper portion of the reinforcing wall structure and continues along the same direction as the upper portion for a predetermined distance before being folded back into the soil to anchor the edging material.

51. An apparatus according to claim 50, wherein the edging material comprises a porous geotextile or porous plastics sheeting.

52. A reconfigurable activity surface comprising a plurality of sections, a first one of the sections being provided in a movable tray that can be moved into engagement with a second one of the sections to form at least a portion of the activity surface, the first section comprising an overlapping edge which is inclined to the vertical and complimentary with a corresponding edge of the second section, such that the first section can be joined to be apparently seamless with the second section.

53. A reconfigurable activity surface according to claim 52, wherein only upper portions of the edge of the first section and the second section are inclined to the vertical.

54. A reconfigurable activity surface according to claim 53, wherein said activity surface comprises an activity pitch provided in a stadium.

55. A reconfigurable activity surface according to claim 54, wherein the pitch is turfed.

56. A reconfigurable tray moving apparatus for constructing part of a reconfigurable activity surface, the apparatus comprising a set of guide rails and at least one tray providing part of the activity surface, which is movable on the rails, the apparatus further comprising means for moving the at least one tray laterally with respect to the direction of travel of the tray on the rails in order to effect alignment of the tray with an edge of the activity surface.

57. An apparatus according to claim 56, wherein the lateral moving means comprises a set of wheels, each set having wheels oversized in width in relation to the width of the rails, thereby allowing relative lateral movement between the wheel and the rail.

58. An apparatus according to claim 56, wherein the lateral moving means comprises a secured alignment means positionable at a predetermined position with respect to the edge of the activity surface and guide means providable on the movable tray to co-operate with the alignment means to align the movable tray with the edge of the activity surface prior to secure engagement therewith.

59. An apparatus according to claim 58, wherein the secured alignment means is provided at two locations corresponding to the respective positions of the ends of the tray along the direction of travel at engagement with the edge of the activity surface.

60. An apparatus according to claim 58, wherein the guide means comprises adjustment means for adjusting the relative position of the guide means to the tray.

61. An apparatus according to claim 58, the alignment means comprises an elongate wedge and the guide means comprises a wheeled assembly for engaging the elongate wedge to effect said lateral alignment.

62. A reconfigurable movable tray apparatus comprising a plurality of movable trays each providing a part of an activity surface and a set of guide rails wherein the trays are provided with engaging wheels which enable the trays to be movable on the guide rails to a desired coupling position and be securely located at the coupling position by transferring the weight of the tray from the guide wheels to fixed support means of the tray.

63. An apparatus according to claim 62, wherein the apparatus is arranged to transfer the weight from the fixed support means of the movable tray to the guide wheels at the secure coupling position prior to moving the tray on the guide rails via the wheels to another position away from the coupling position.

64. An apparatus according to claim 62, wherein each tray comprises a plurality of over-centre pivot arms each connected at one end to a guide wheel and having a hydraulic actuator provided at the other end, the over-centre pivot arms being arranged to be movable between two positions in order to effect the transfer of the weight.

65. An apparatus according to claim 64, wherein each of the hydraulic actuators is controlled by a hydraulic power means which circulates hydraulic fluid to each actuator.

66. An apparatus according to claim 65, wherein a flow divider means is provided for dividing the hydraulic fluid evenly between the hydraulic actuators to effect simultaneous and even actuation of the hydraulic actuators.

67. A replaceable section of an activity surface, the section being provided on a movable reconfigurable tray and being arranged to disengage the activity surface and be moved away therefrom to be replaced by another section of the activity surface provided on the movable tray, wherein the movable tray is arranged to engage its edges with corresponding edges of the activity surface at an angle to the plane in which at least the upper portions of the edges of the activity surface are provided.

68. A section according to claim 67, wherein the activity surface comprises a pathway.

69. A section according to claim 67, wherein the activity surface is a part of a turfed playing field.

70. A section according to claim 69, wherein the activity surface is provided in a stadium.

71. A section according to claim 67, wherein the activity surface has regions which wear at different rates and the replaceable section is provided in a region of excessive wear.

72. A section according to claim 67, wherein the tray is movable on rails.

73. A section according to claim 67, wherein said activity surface comprises a racetrack.

74. A section according to claim 67, wherein said activity surface comprises a sports activity pitch.

75. A replaceable section of an activity surface, the section being provided on a movable reconfigurable tray and being arranged to disengage the activity surface and be moved away therefrom to be replaced by another section of the activity surface provided on the movable tray, wherein the movable tray is circular in shape and the section is moved away from the activity surface by being rotated about the centre of the tray.

76. A section according to claim 75, wherein the activity surface comprises a pathway.

77. A section according to claim 75, wherein the activity surface is a part of a turfed playing field.

78. A section according to claim 77, wherein the activity surface is provided in a stadium.

79. A section according to claim 75, wherein the activity surface has regions which wear at different rates and the replaceable section is provided in a region of excessive wear.

80. A section according to claim 75, wherein the tray is movable on rails.

81. A section according to claim 75, wherein said activity surface comprises a racetrack.

82. A section according to claim 75, wherein said activity surface comprises a sports activity pitch.

* * * * *